US005528257A

United States Patent [19]

Okumura et al.

[11] Patent Number: 5,528,257

[45] Date of Patent: Jun. 18, 1996

[54] DISPLAY DEVICE

[75] Inventors: Haruhiko Okumura, Kawasaki; Kouhei Suzuki, Yokohama, both of Japan

[73] Assignee: Kabushiki Kaisha Toshiba, Kawasaki, Japan

[21] Appl. No.: 269,026

[22] Filed: Jun. 30, 1994

[30] Foreign Application Priority Data

Jun. 30, 1993 [JP] Japan ..... 5-189183

[51] Int. Cl.[6] ..... G09G 3/36

[52] U.S. Cl. ..... 345/99; 345/94

[58] Field of Search ..... 345/89, 98, 99, 345/100, 101

[56] References Cited

U.S. PATENT DOCUMENTS 5,119,084 6/1992 Kawamura et al. .
5,159,326 10/1992 Yamazaki et al. ..... 345/101
5,168,270 12/1992 Masumori et al. ..... 345/100
5,353,041 10/1994 Miyamoto et al. ..... 345/100

FOREIGN PATENT DOCUMENTS 2113294 4/1990 Japan .

*Primary Examiner*—Tommy P. Chin
*Assistant Examiner*—Gin Goon
*Attorney, Agent, or Firm*—Oblon, Spivak, McClelland, Maier & Neustadt

[57] ABSTRACT

A display device is composed of a liquid crystal display panel, having modulating characteristics in which a relationship between a transmittance and a drive voltage depends on the direction of a change in the drive voltage, for modulating source light in a two-dimensional area, and a processing channel for applying a drive voltage according to each of pixel signals which change for each 1-field period. Particularly, the processing channel includes a field memory for delaying transmittance data corresponding to the pixel signal by the 1-field period, and a characteristic compensating circuit for converting the transmittance data to a drive voltage data on the basis of conversion characteristics which vary with the data delayed by the field memory, and determining the drive voltage according to the drive voltage data.

17 Claims, 11 Drawing Sheets

DISPLAY DEVICE

BACKGROUND OF THE INVENTION

1. Field of the Invention

The present invention relates to a display device having an optical modulation element for modulating source light in a two-dimensional area and, more particularly, to a display device used for displaying moving images in tones.

2. Description of the Related Art

In recent years, a liquid crystal display panel having a high brightness level and a wide viewing angle has been developed. This liquid crystal display panel is an optical modulation element including a pair of transparent substrates in which a matrix of pixel electrodes and a single common electrode are respectively arranged, and a polymer dispersed liquid crystal cell having a polymer resin containing a liquid crystal material and held between the substrates or a fine particle dispersed liquid crystal cell having a liquid crystal material containing fine particles and held between the substrates. In this liquid crystal display panel, the light scattering property of the liquid crystal cell is controlled by a drive voltage applied between the common electrode and each pixel electrode. For example, when the liquid crystal cell is set in an opaque light scattering state at a drive voltage of 0 V, the transmittance of the liquid crystal cell increases with an increase in the drive voltage, and the liquid crystal cell is finally set in a transparent light-transmission state.

For example, a polymer dispersed liquid crystal cell (PDLC) has the following drawbacks. FIG. 1 shows the modulation characteristics, i.e., the transmittance-to-voltage characteristics of the PDLC. FIG. 2 shows the response characteristics of the PDLC, i.e., the relationship between the response time to a change in the drive voltage. Referring to FIG. 2, the voltage axis indicates an initial level of a change in the drive voltage, reference symbols V1 to V8 respectively indicate final levels of the change in the drive voltage. In this case, in order to easily understand the modulation characteristics of the PDLC shown in FIG. 1, FIG. 3 exaggeratedly shows the modulation characteristics shown in FIG. 1. As is apparent from FIG. 3, the modulation characteristics of the PDLC have hysteresis in which the transmittance depends on the direction of the change in the drive voltage. More specifically, the transmittance changes along a characteristic curve CV1 when the drive voltage increases, and the transmittance changes along a curve CV2 when the drive voltage decreases. Therefore, two transmittance levels exist for a level P of the drive voltage.

When the liquid crystal display panel displays moving images in tones, images for successive field are overlapped due to the hysteresis. In addition, the response of the PDLC is considerably delayed when the drive voltage is changed for designating halftones between white and black corresponding to the transmittance of 0% and 100%. This is a factor for forming an afterimage when the liquid crystal display panel displays moving images in tones. In addition, a threshold value Vth of the PDLC easily changes depending on a change in temperature. Due to the above problems, in the polymer dispersed liquid crystal display panel it is hard to obtain good image quality in a case where the polymer dispersed liquid crystal display panel is used as a TV display.

A TN liquid crystal display panel has been popular prior to the above polymer dispersed liquid crystal display panel. A typical TN liquid crystal display panel comprises a pair of transparent substrates in which a matrix of pixel electrodes and a single common electrode are respectively arranged, a liquid crystal cell held between these substrates, and a pair of polarizing plates affixed to the outer surfaces of the substrates with a phase difference of 90 degrees. An alignment process is performed on the surfaces of these substrates which are set to be in contact with the liquid crystal cell, in order to obtain a TN-alignment of liquid crystal molecules on the axis extending in the thickness direction of the liquid crystal cell. When source light is linearly polarized by one polarizing plate and then incident on the liquid crystal cell, the polarized light is rotated through 90 degrees and guided to the other polarizing plate. When a drive voltage is applied between the common and one of the pixel electrodes, the liquid crystal molecules are tilted up in an area between these electrodes to obtain birefringent polarized light so as to prevent the polarized light from passing through the other polarizing plate.

However, when this liquid crystal display panel is used as a TV display, the response characteristics of the liquid crystal cell pose a problem. Conventionally, various attempts have been made to improve the response characteristics.

The response characteristics of a liquid crystal cell depend on a time tr required for tilting up liquid crystal molecules in an electric field generated by a drive voltage applied between a pixel electrode and a common electrode and a time td required for returning the alignment of the liquid crystal molecules to the original state by a force acting between molecules when the electric field is removed. The times tr and td are expressed by the following equations:

$$tr=\eta d^2/(\Delta\epsilon V-K\pi^2) \quad (1)$$

$$td=\eta d^2/K\pi^2 \quad (2)$$

In this case, K is a constant expressed by $K=K_1+(K_3-2K_2)/4$, where the elastic constants of the divergence, torsion, and bending of the liquid crystal are represented by $K_1$, $K_2$, and $K_3$, respectively; $\Delta\epsilon$ is a difference $(\epsilon_s-\epsilon_p)$ between a parallel dielectric constant $\epsilon_s$ of the liquid crystal molecules and a perpendicular dielectric constant $\epsilon_p$ of the liquid crystal molecules; $\eta$ is the torsional viscosity of the liquid crystal molecules; d is the thickness of the liquid crystal cell (the gap between the substrates); and V is a drive voltage applied between the pixel electrode and the common electrode to tilt up the liquid crystal molecules. As is apparent from equations (1) and (2), the response time of the liquid crystal cell can be shortened by decreasing the constant $\eta$, decreasing the thickness d, or increasing the constant K. However, the constants $\eta$ and K are inherent to a material, and the thickness d cannot be minimized because the minimum transmittance is determined by the relationship between the thickness d and a difference $\Delta n$ indicating the anisotropy of a refractive index. For this reason, an effort for changing the constants $\eta$ and K, the difference $\Delta n$, and the like has been continued by blending various liquid crystal materials with each other. The tilt-up time tr can be shortened by changing the difference $\Delta\epsilon$ or the voltage V. The tilt-down time td can be shortened by a known technique of applying a high-frequency voltage between the electrodes when the drive voltage V is removed, in order to set the anisotropy of a dielectric constant to be negative.

The countermeasures described above are effective only when the liquid crystal cell is used to display images in two tones of white and black, which are set in the states where light is transmitted and blocked, respectively. When the liquid crystal is used to display images in tones including halftones between white and black, a more complex situation must be considered.

FIG. 3A shows one liquid crystal molecule 3 which is present between electrodes 1 and 2 in the TN liquid crystal display panel. Referring to FIG. 3A, reference symbol θ denotes an angle between the liquid crystal molecule 3 and an x-axis on an X-Y plane parallel to the electrodes 1 and 2, and reference symbol ø denotes an angle between the liquid crystal molecule 3 and a z-axis perpendicular to the X-Y plane. When a drive voltage is applied between the electrodes 1 and 2, an electric field in the z-axis direction is applied to the liquid crystal molecule 3. At this time, hydrodynamic equations of the liquid crystal molecule 3 are as follows:

$$\gamma 1 \cdot \partial\theta/\partial t = f(\theta)(\partial^2\theta/\partial z^2) + (f(\theta)\partial\theta/\partial z)/\partial z + g(\theta)(\partial\phi/\partial z)^2 + e(\theta)(\partial\phi/\partial z) + h(\theta)D_z^2/4\pi \quad (3)$$

$$\gamma 1 \cdot \partial\theta/\partial t = (1/\cos^2\theta) \cdot (u(\theta)(\partial\theta/\partial z) + v(\theta))/\partial z \quad (4)$$

Although these equations are nonlinear partial differential equations which cannot be analytically solved, these equations can be solved by numerical calculations. In addition, a drive voltage V applied between the electrodes 1 and 2 is expressed by the following equation:

$$V = (D_z/\epsilon_p)\int_0^d dz/(1 + a\sin^2\theta) \quad (5)$$

where $a=(\epsilon_s-\epsilon_p)/\epsilon_p$, and $D_z$ is an electric flux density.

As is apparent from equations (3) to (5), the inclination of the liquid crystal molecule depends on the drive voltage which changes with time. The transit angles θ(z, t) and ø(z, t) of the liquid crystal molecule can be obtained by simultaneously solving equations (3) to (5). The response characteristics of the liquid crystal molecule can be finally derived such that the angles θ(z, t) and ø(z, t) obtained as described above are substituted in a Barrman 4×4 matrix and this matrix is solved.

On the other hand, FIG. 3B shows modulation characteristics representing the relationship between the drive voltage and the transmittance of the liquid crystal cell. Referring to FIG. 3B, assuming that the liquid crystal cell is normally white, the drive voltage requires an amplitude of about 5 V to obtain a contrast ratio of 100/1. When only the halftone range between black and white is considered, the drive voltage is set to an amplitude of 1.5 to 2 V. This means that an image display is delayed in the halftone range.

This delay poses a problem when the liquid crystal display device is used as a full-color TV display. The full-color TV display requires a liquid crystal cell whose response time is less than 10 msec in the halftone range. However, the response time of existing liquid crystal cells exceeds 20 msec even if images are displayed in two tones of white and black. This result in that a considerable afterimage phenomenon occurs when the liquid crystal display cell is used to display moving images.

SUMMARY OF THE INVENTION

The present invention has been made in consideration of the above circumstances, and has as its object to provide a display device capable of faithfully reproducing moving images.

The above object is achieved by a display device which comprises an optical modulating element, having modulating characteristics in which a relationship between a transmittance and a drive voltage depends on the direction of a change in the drive voltage, for modulating source light in a two-dimensional area; and a driving section for applying a drive voltage according to each of pixel signals which change for each predetermined period; wherein the driving section includes a delaying circuit for delaying said pixel signal by the predetermined period, and a characteristic compensating circuit for converting the pixel signal to a drive voltage signal on the basis of conversion characteristics which vary with the signal delayed by the delaying circuit, and determining the drive voltage according to the drive voltage signal.

According to the display device, the characteristic compensating circuit converts the pixel signal to a drive voltage signal on the basis of converting characteristics which vary with the signal delayed by the delaying circuit, and determines, according to the drive voltage signal, the drive voltage for the optical modulating element having modulating characteristics in which a relationship between a transmittance and a drive voltage depends on the direction of a change in the drive voltage. That is, the drive voltage can be adjusted such that the transmittance designated by the pixel signal can be obtained. Therefore, when the optical modulating element is used for displaying moving images in tones including the halftone range, moving images can be faithfully reproduced without any overlap in the images.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1A:
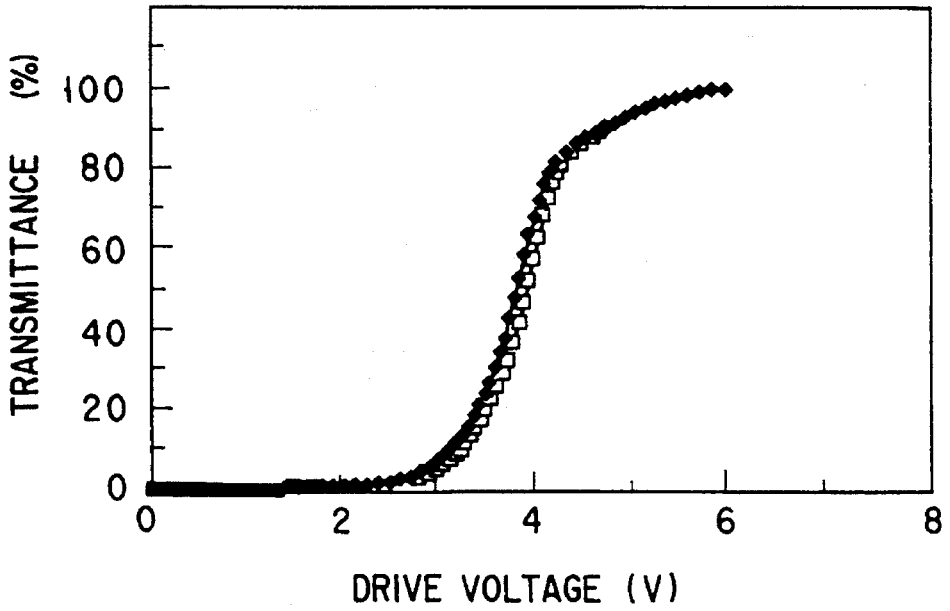
FIG. 1A (PRIOR ART)
FIG. 1A is a graph showing the modulation characteristics of a polymer dispersed liquid crystal cell.
Figure 1B:
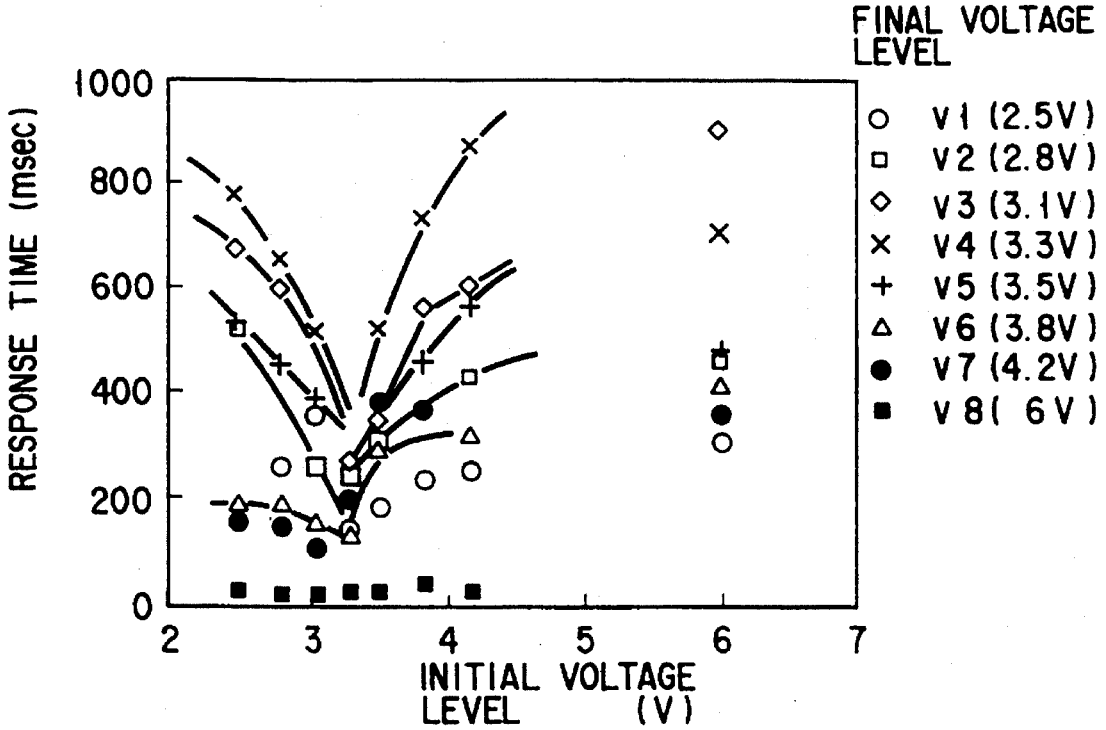
FIG. 1B (PRIOR ART)
FIG. 1B is a graph showing the response characteristics of the polymer dispersed liquid crystal cell.
Figure 2:
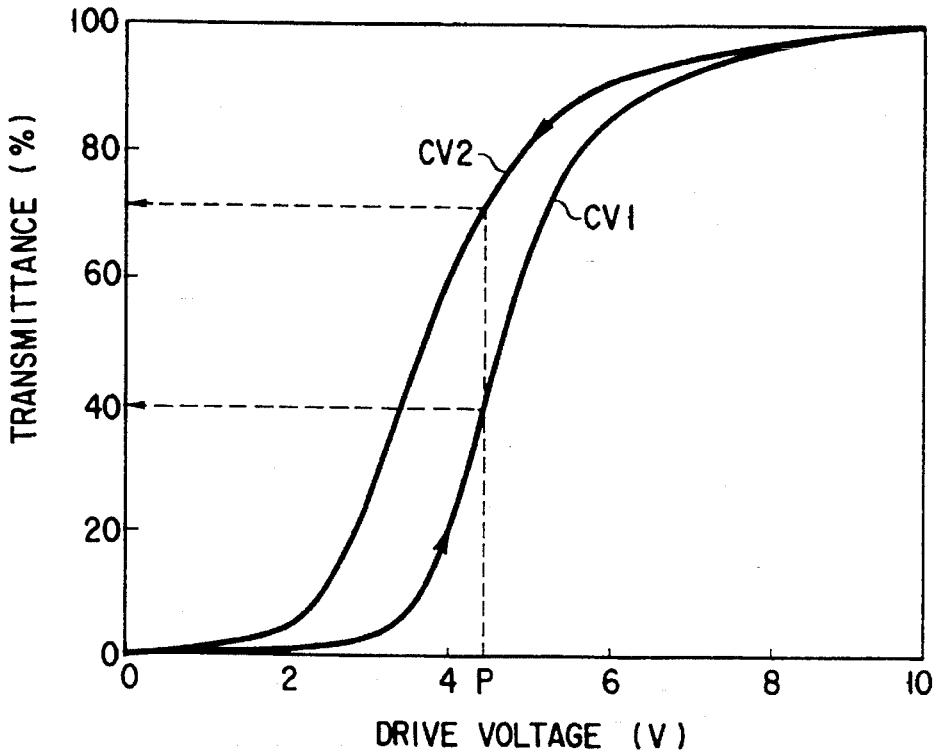
FIG. 2 (PRIOR ART)
FIG. 2 is a graph exaggeratedly showing the modulation characteristics shown in FIG. 1.
Figure 4:
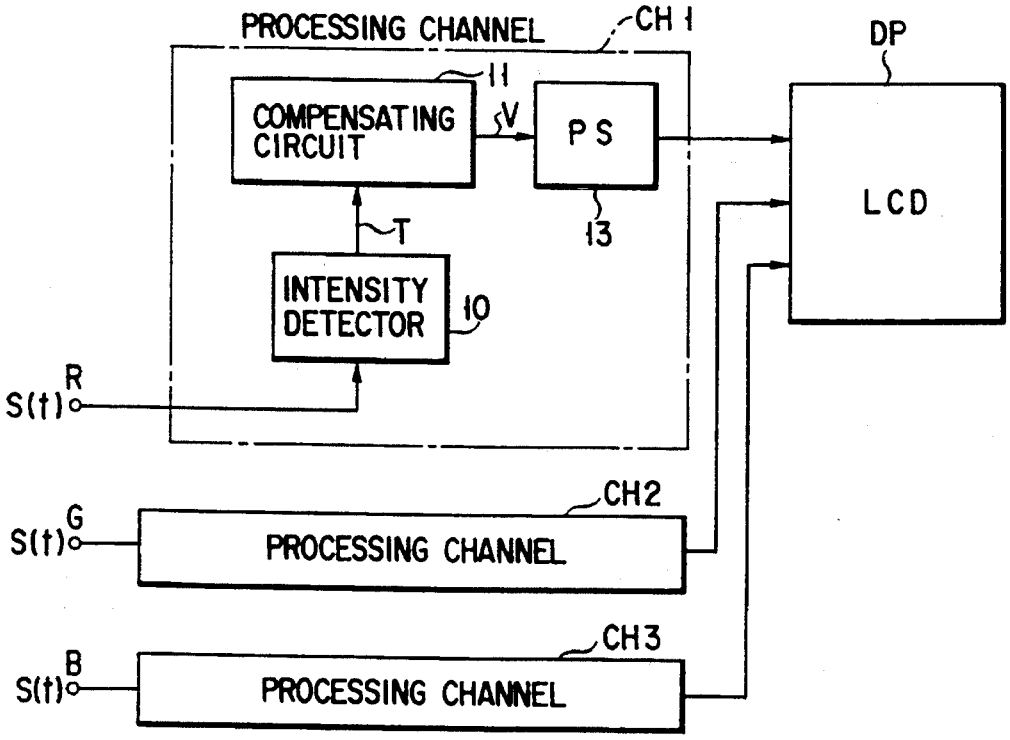
FIG. 4 is a block diagram schematically showing the arrangement of a liquid crystal display device according to the first embodiment of the present invention.
Figure 3A:
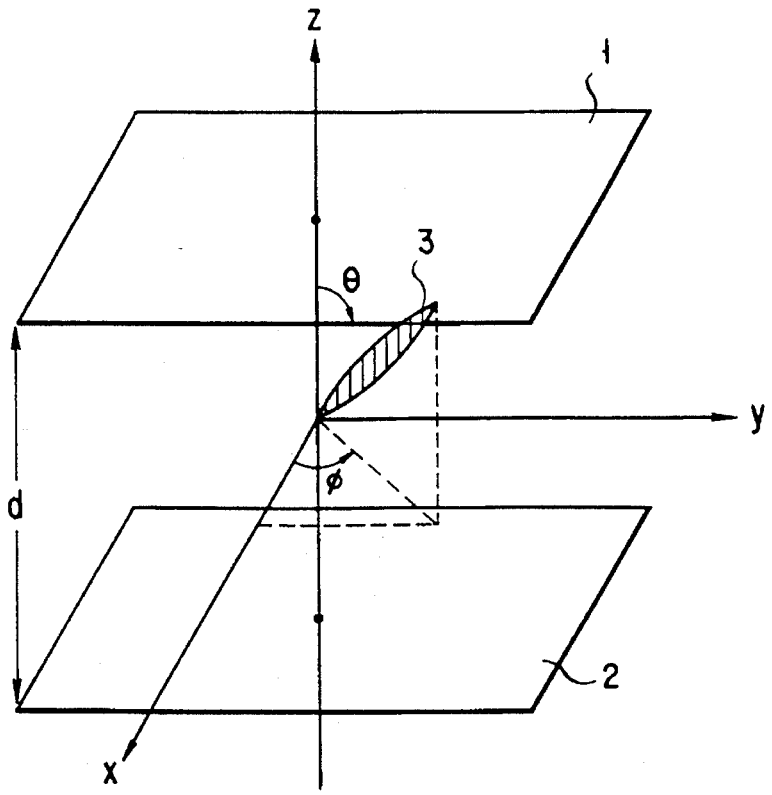
FIG. 3A (PRIOR ART)
FIG. 3A is a view showing the inclination of a liquid crystal molecule in a TN liquid crystal cell.
Figure 3B:
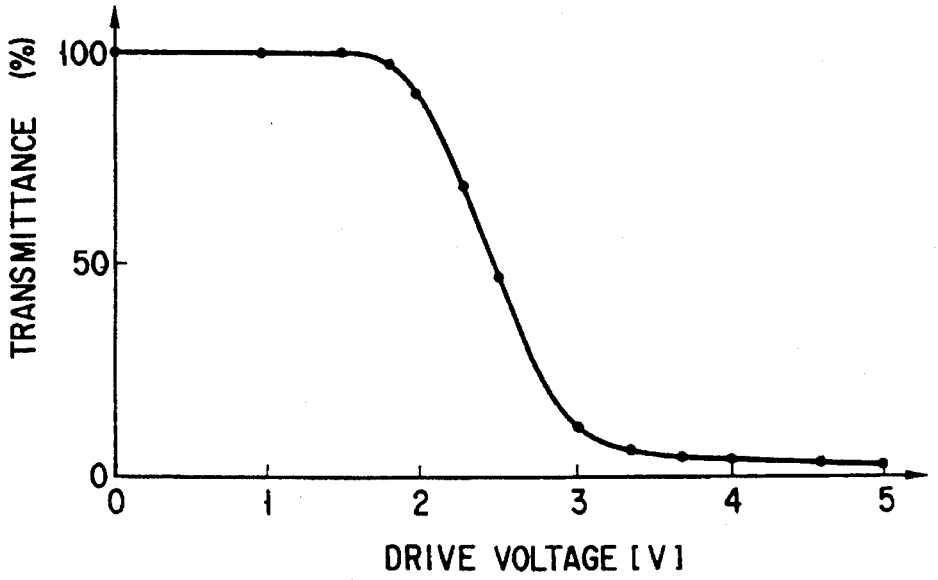
FIG. 3B (PRIOR ART)
FIG. 3B is a graph showing the modulation characteristics of the TN liquid crystal cell.

A liquid crystal display device according to the first embodiment of the present invention will be described below with reference to the accompanying drawings. FIG. 4 shows the circuit arrangement of this liquid crystal display device. This liquid crystal display device comprises processing channels CH1 to CH3 for respectively processing three image signals S(t) obtained by separating a color video signal into color components of red, green, and blue, and a liquid crystal display (LCD) panel DP which is driven according to RGB signals from the processing channels CH1 to CH3. The image signal S(t) includes pixel signals arranged in units of fields on a time axis to designate intensity (or transmittance) levels for pixels. The LCD panel DP is a polymer dispersed liquid crystal display panel conventionally known, and has an active matrix structure in which a plurality of TFTs (Thin Film Transistors) are formed as switching elements for pixel electrodes arrayed in a matrix form on an array substrate. The rows of TFTs are sequentially selected in synchronism with the horizontal scanning cycle of the RGB signals. The selected TFTs supply pixel signals extracted from each of the RGB signals for one horizontal scanning period to those pixel electrodes of a corresponding color component which are connected to the selected TFTs.

The processing channels CH1 to CH3 have arrangements similar to each other. Each of the processing channels has an intensity detector 10 for sequentially detecting intensity (or transmittance) levels from pixel signals included in the image signal S(t) and converting each transmittance level into 8-bit transmittance data T, a characteristic compensating circuit 11 for generating 10-bit drive voltage data V on the basis of the transmittance data T from the intensity detector 10, and a polarity switching circuit 13 for generating a drive voltage designated by the drive voltage data V from the compensating circuit 11 and switching the polarity of the drive voltage for each horizontal scanning period. The RGB signals are constituted by three voltage signals respectively obtained from the polarity switching circuits 13 of the processing channels CH1 to CH3.

Figure 5:
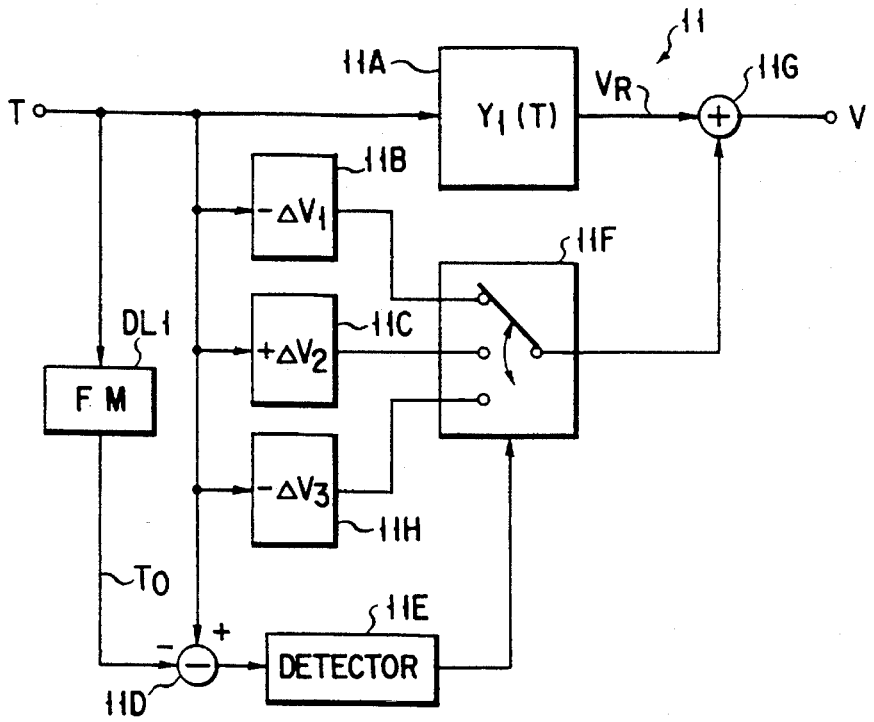
FIG. 5 is a block diagram showing the arrangement of a characteristic compensating circuit in FIG. 4 more in detail.
Figure 6:
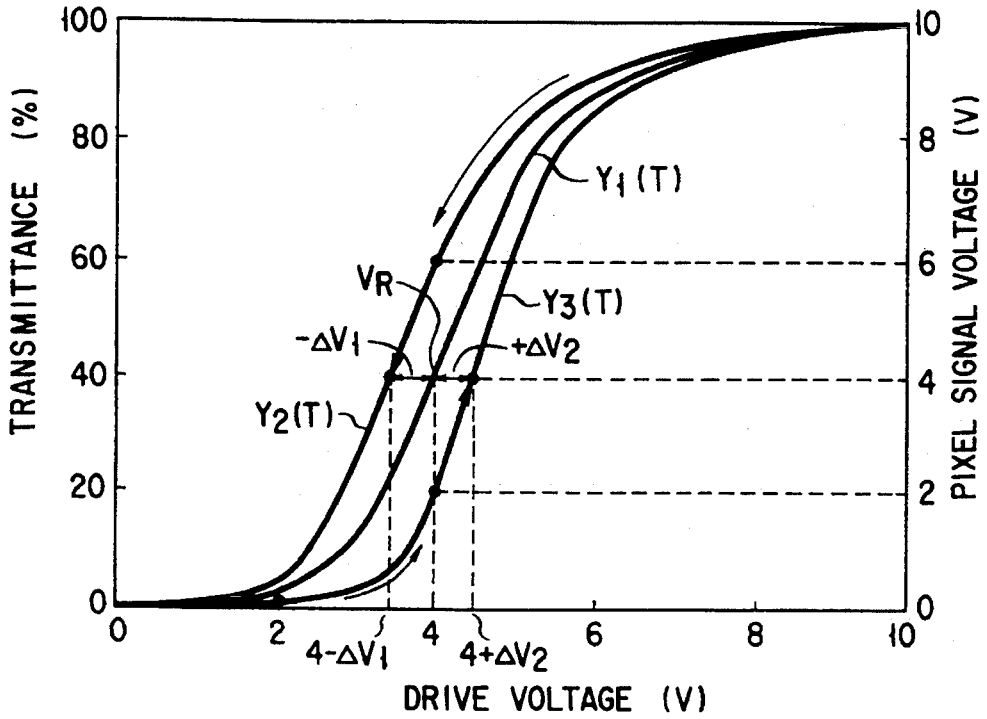
FIG. 6 is a graph showing the modulation characteristics of a liquid crystal display panel in FIG. 4.

FIG. 5 shows the structure of the characteristic compensating circuit 11 in detail. FIG. 6 shows the modulation characteristics or transmittance-to-voltage characteristics of the LCD panel DP. The characteristic compensating circuit 11 is used to compensate for the hysteresis of the modulation characteristics shown in FIG. 6. The compensating circuit 11 has a field memory DL1 for sequentially storing transmittance data T for one field and outputting each transmittance data T as delay data $T_0$ with a delay of a 1-field period, a reference characteristic table 11A for generating reference voltage data $V_R$ corresponding to the transmittance data T, a correction table 11B for generating correction data $-\Delta V_1$ corresponding to the transmittance data T, a correction table 11C for generating correction data $+\Delta V_2$ corresponding to the transmittance data T, a correction table 11H for generating correction data $-\Delta V_3$ corresponding to the transmittance data T, a subtracter 11D for subtracting the delay data $T_0$ from the transmittance data T to obtain a difference therebetween, a detector 11E for detecting whether the difference is negative, positive, or zero, a switch 11F for selecting the correction data $-\Delta V_1$ when the difference is negative, correction data $+\Delta V_2$ when the difference is positive, and correction data $-\Delta V_3$ when the difference is zero, and an adder 11G for adding the correction data selected by the switch 11F to the reference voltage data $V_R$ from the reference characteristic table 11A.

Referring to FIG. 6, $Y_1(T)$ indicates a reference characteristic curve obtained when hysteresis is omitted, $Y_2(T)$ indicates a characteristic curve for a decrease in the drive voltage, and $Y_3(T)$ indicates a characteristic curve for an increase in the drive voltage. The reference characteristic table 11A is formed of a ROM storing a set of reference voltage data $V_R$ to be selected by the transmittance data T. Each reference voltage data $V_R$ is 10-bit data representing a drive voltage obtained from the characteristic curve $Y_1(T)$ with respect to the transmittance data T, and the reference voltage data $V_R$ is assigned to the entire bits of the drive voltage data V. The number of bits in the reference voltage data $V_R$ is set larger than that of the transmittance data T in order to perform a non-linear conversion (gamma correction). The correction table 11B is formed of a ROM storing a set of correction data $-\Delta V_1$ to be selected by the transmittance data T. Each correction data $-\Delta V_1$ is 8-bit data representing a difference $(Y_2(T)-Y_1(T))$ between drive voltages obtained from the reference characteristic curve $Y_1(T)$ and the characteristic curve $Y_2(T)$ with respect to the transmittance data T, and the correction data $-\Delta V_1$ is assigned to the lower 8 bits of the drive voltage data V. The correction table 11C is formed of a ROM storing a set of correction data $+\Delta V_2$ to be selected by the transmittance data T. Each correction data $+\Delta V_2$ is 8-bit data representing a difference $(Y_3(T)-Y_1(T))$ between drive voltages obtained from the reference characteristic curve $Y_1(T)$ and the characteristic curve $Y_3(T)$ with respect to the transmittance data T, and the correction data $+\Delta V_2$ is assigned to the lower 8 bits of the drive voltage data V. The correction table 11H is formed of a ROM storing a set of correction data $-\Delta V_3$ to be selected by the transmittance data T. Each correction data $-\Delta V_3$ is 8-bit data representing a difference $(Y_{2S}(T)-Y_1(T))$ between drive voltages obtained from the reference characteristic curve $Y_1(T)$ and a virtual characteristic curve $Y_{2S}(T)$, which is obtained by shifting upward the characteristic curve $Y_2(T)$ along a transmittance axis, with respect to the transmittance data T, and the correction data $-\Delta V_3$ is assigned to the lower 8 bits of the drive voltage data V. In this case, the shift amount of the characteristic curve $Y_2(T)$ is set such that the difference between the correction data $-\Delta V_3$ and the correction data $-\Delta V_1$ obtained with respect to the transmittance data T is minimized within an 8-bit range. This setting is performed to decrease the drive voltage along the characteristic curve $Y_2(T)$ by a level sufficiently smaller than that obtained when the transmittance data T decreases by one step. In addition, the number of bits of the correction data $-\Delta V_1$, $+\Delta V_2$, or $-\Delta V_3$ can be reduced if a distance between the hysteresis characteristic curves $Y_2(T)$ and $Y_3(T)$ is relatively small.

In each processing channel, the input image signal S(t) is supplied to the intensity detector 10 through a corresponding one of input terminals R, G, and B. The intensity detector 10 sequentially detects intensity (or transmittance) levels from pixel signals included in the image signal S(t) and converts each transmittance level into transmittance data T. The characteristic compensating circuit 11 generates drive voltage data V on the basis of the transmittance data T to obtain the transmittance designated by the transmission data T regardless of hysteresis. In the compensating circuit 11, the transmittance data T is supplied to the field memory DL1, the tables 11A, 11B, 11C, and 11H, and the subtracter 11D. The reference characteristic table 11A generates reference voltage data $V_R$ corresponding to the transmittance data T, and supplies it to the adder 11G. The correction table 11B generates correction data $-\Delta V_1$ corresponding to the transmittance data T, and supplies it to the switch 11F. The correction table 11C generates correction data $+\Delta V_2$ corresponding to the transmittance data T, and supplies it to the switch 11F. The field memory DL1 delays the transmittance data T by a 1-field period, and supplies it to the subtracter 11D as the delay data $T_0$. The subtracter 11D subtracts the delay data $T_0$ from the transmittance data T, and supplies the subtraction result to the detector 11E. The detector 11E detects whether the subtraction result is negative, positive, or zero. The switch 11F selects the correction data $-\Delta V_1$ when the subtraction result is negative, the correction data $+\Delta V_2$ when the subtraction result is positive, and correction data $-\Delta V_3$ when the subtraction result is zero. The adder 11G adds the correction data selected by the switch 11F to the reference voltage data $V_R$ from the reference characteristic table 11A, and supplies the addition result to the polarity switching circuit 13 as drive voltage data V.

For example, when the transmittance data T changes from 20% (=2 V) to 40% (=4 V) with a change in field, the subtracter 11D subtracts the delay data $T_0$ (=2 V) from the transmittance data T (=4 V), and the detector 11E detects that the resultant value is positive. For this reason, the switch 11F selects the correction data $+\Delta V_2$ from the correction table 11C, and the adder 11G adds the correction data $+\Delta V_2$ to the reference voltage data $V_R$ (=4 V) from the reference characteristic table 11A. Therefore, the drive voltage data V is set to be $(4+\Delta V_2)$.

When the transmittance data T changes from 60% (=6 V) to 40% (=4 V) with a change in field, the subtracter 11D subtracts the delay data $T_0$ (=6 V) from the transmittance data T (=4 V), and the detector 11E detects that the subtraction result is negative. For this reason, the switch 11F selects the correction data $-\Delta V_1$ form the correction table 11B, and the adder 11G adds the correction data $-\Delta V_1$ to the reference voltage data $V_R$ (=4 V) from the reference characteristic table 11A. Therefore, the drive voltage data V is set to be $(4-\Delta V_1)$.

In addition, when the transmittance data T is kept at 40% (=4 V) regardless of a change in field, the subtracter 11D subtracts the delay data $T_0$ (=4 V) from the transmittance data T (=4 V), and the detector 11E detects that the subtraction result is zero. For this reason, the switch 11F selects the correction data $-\Delta V_3$ from the correction table 11H, and the adder 11G adds the correction data $-\Delta V_3$ to the reference voltage data $V_R$ (=4 V) from the reference characteristic table 11A. Therefore, the drive voltage data V is set to be $(4-\Delta V_3)$.

Figure 7:
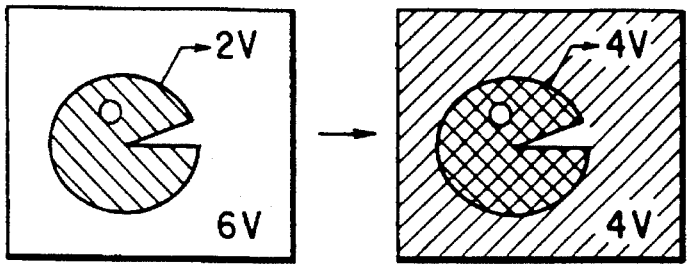
FIG. 7 is a diagram showing overlapped images to be remedied by the embodiment.

If it is assumed that the liquid crystal display device does not compensate for hysteresis, reference voltage data $V_R$ from the characteristic table 11A is output as the drive voltage data V. When the drive voltage data V selectively designates 2 V or 6 V in an initial field and only 4 V in the next field, an image displayed by the LCD panel-DP changes as shown in FIG. 7. That is, the intensity of the image is set higher than a desired level in pixel areas where the drive voltage changes from 6 V to 4 V, and lower than the desired level in pixel areas where the drive voltage changes from 2 V to 4 V. For this reason, images for two successive fields are overlappingly displayed.

However, in the liquid crystal display device according to this embodiment, the transmittance of the LCD panel DP is controlled after the hysteresis has been compensated for according to the direction of a change in the transmittance data T. For this reason, the overlapped images can be prevented from being displayed.

Note that the correction data $-\Delta V_3$ may be changed into correction data $+\Delta V_3$. More specifically, the correction data $+\Delta V_3$ is 8-bit data representing a difference $(Y_{3S}(T)-Y_1(T))$ between drive voltages obtained, with respect to the transmittance data T, from the reference characteristic curve $Y_1(T)$ and a virtual characteristic curve $Y_{3S}(T)$ obtained by shifting the characteristic curve $Y_3(T)$ downward along the transmittance axis. This 8-bit data is assigned to the lower 8 bits of the drive voltage data V. In this case, the shift amount of the characteristic curve $Y_3(T)$ is set such that the difference between the correction data $+\Delta V_3$ and the correction data $+\Delta V_2$ obtained with respect to the transmittance data T is minimized within an 8-bit range. This setting is performed to increase the drive voltage along the characteristic curve $Y_3(T)$ by a level sufficiently smaller than that obtained when the transmittance data T increases by one step.

In this embodiment, the drive voltage data V is expressed by 10 bits, and the correction data $-\Delta V_1$, $+\Delta V_2$, and $-\Delta V_3$ are expressed by 8 bits. However, the number of bits of each data can be reduced with taking the magnitude of hysteresis or the transmittance-voltage characteristics of the LCD panel DP into consideration.

Figure 8:
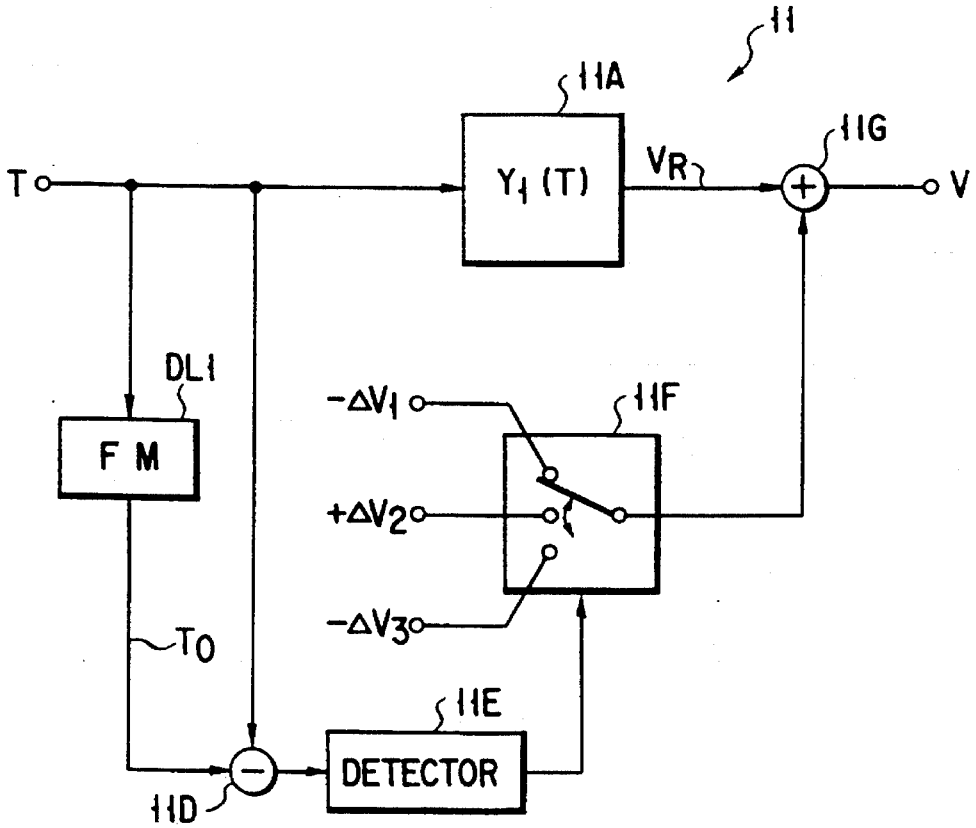
FIG. 8 is a block diagram showing the arrangement of a characteristic compensating circuit of a liquid crystal display device according to the second embodiment of the present invention.

A liquid crystal display device according to the second embodiment of the present invention will be described below with reference to the accompanying drawings. This liquid crystal display device has the same arrangement as that of the liquid crystal display device of the first embodiment except that a characteristic compensating circuit 11 has the arrangement shown in FIG. 8. For this reason, a repetitive description will be omitted, and the same reference numerals as in the first embodiment denote the substantially same components in FIG. 8.

This embodiment is applied to a case where an error can be limited to less than 10% when a reference characteristic curve $Y_1(T)$ is shifted along the drive voltage axis in order to approximate characteristic curves $Y_2(T)$ and $Y_3(T)$.

The characteristic compensating circuit 11 is used to compensate for the hysteresis of the modulation characteristics shown in FIG. 6. This compensating circuit 11 has a field memory DL1 for sequentially storing transmittance data for one field T and outputting each transmittance data T as delay data $T_0$ with a delay of a 1-field period, a reference characteristic table 11A for generating reference voltage data $V_R$ corresponding to the transmittance data T, a subtracter 11D for subtracting the delay data $T_0$ from the transmittance data T, a detector 11E for detecting whether a subtraction result from the subtracter 11D is negative, positive, or zero, a switch 11F for selecting correction data $-\Delta V_1$ when the subtraction result is negative, correction data $+\Delta V_2$ when the subtraction result is positive, and correction data $-\Delta V_3$ when the subtraction result is zero, and an adder 11G for adding the correction data selected by the switch 11F to the reference voltage data $V_R$ from the reference characteristic table 11A.

The reference characteristic table 11A is formed of a ROM storing a set of reference voltage data $V_R$ to be selected by the transmittance data T. Each reference voltage data $V_R$ is 10-bit data representing a drive voltage obtained from the characteristic curve $Y_1(T)$ with respect to the transmittance data T, and the reference voltage data $V_R$ is assigned to the entire bits of the drive voltage data V. The correction data $-\Delta V_1$ is 8-bit data representing a voltage equal to a shift amount for limiting an error to less than 10% when the reference characteristic curve $Y_1(T)$ is shifted to the side of the characteristic curve $Y_2(T)$, and the correction data $-\Delta V_1$ is assigned to the lower 8 bits of the drive voltage data V. The correction data $+\Delta V_2$ is 8-bit data representing a voltage equal to a shift amount for limiting an error to less than 10% when the reference characteristic curve $Y_1(T)$ is shifted to the side of the characteristic curve $Y_3(T)$, and the correction data $+\Delta V_2$ is assigned to the lower 8 bits of the drive voltage data V. The correction data $-\Delta V_3$ is larger than the correction data $-\Delta V_1$, and 8-bit data representing a voltage set such that a difference between the correction data $-\Delta V_3$ and the correction data $-\Delta V_1$ is minimized within an 8-bit range. The correction data $-\Delta V_3$ is assigned to the lower 8 bits of the drive voltage data V. This setting is performed to decrease the drive voltage along with the reference characteristic curve shifted to the side of the characteristic curve $Y_2(T)$, by a level sufficiently smaller than that obtained when the transmittance data T decreases by one step.

In this embodiment, since the correction data $-\Delta V_1$, $+\Delta V_2$, and $-\Delta V_3$ are directly applied to input terminals of the switch 11F, the correction tables 11B, 11C, and 11H used in the first embodiment can be made unnecessary.

Note that the correction data $-\Delta V_3$ may be changed into correction data $+\Delta V_3$. More specifically, the correction data $+\Delta V_3$ is larger than the correction data $+\Delta V_2$, and is set such that a difference between the correction data $+\Delta V_3$ and the correction data $+\Delta V_2$ is minimized within an 8-bit range. This setting is performed to increase the drive voltage along the reference characteristic curve shifted to the side of the characteristic curve $Y_3(T)$, by a level sufficiently smaller than that obtained when the transmittance data T increases by one step.

A liquid crystal display device according to the third embodiment of the present invention will be described below with reference to the accompanying drawings. This liquid crystal display device has the same arrangement as that of the liquid crystal display device of the first embodiment except that a characteristic compensating circuit 11 has the arrangement shown in FIG. 9. For this reason, a repetitive description will be omitted, and the same reference numerals as in the first embodiment denote the substantially same components in FIG. 9.

Figure 10:
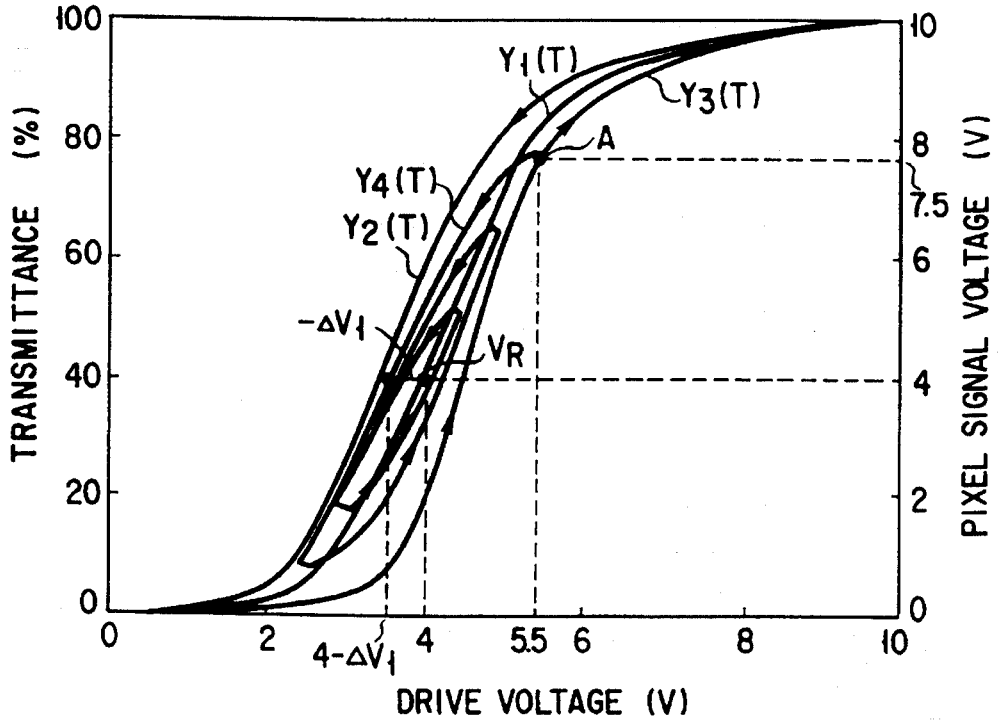
FIG. 10 is a graph for explaining an operation of the characteristic compensating circuit in FIG. 9.

The characteristic compensating circuit 11 is used to compensate for the hysteresis of the modulation characteristics shown in FIG. 10. This compensating circuit 11 has a field memory DL1 for sequentially storing transmittance data T for one field and outputting each transmittance data T as delay data $T_0$ with a delay of a 1-field period, a reference characteristic table 11A for generating reference voltage data $V_R$ corresponding to the transmittance data T, a correction table 11B for generating correction data $-\Delta V_1$ corresponding to data T, $T_0$ and $V_0$, a correction table 11C for generating correction data $+\Delta V_2$ corresponding to the data T, $T_0$, and $V_0$, a correction table 11H for generating correction data $\Delta V_3$ corresponding to the data T and $V_0$, a subtracter 11D for subtracting the delay data $T_0$ from the transmittance data T, a detector 11E for detecting whether a subtraction result from the subtracter 11D is negative, positive, or zero, a switch 11F for selecting the correction data $-\Delta V_1$ when the subtraction result is negative, the correction data $+\Delta V_2$ when the subtraction result is positive, and the correction data $\Delta V_3$ when the subtraction result is zero, and an adder 11G for adding the correction data selected by the switch 11F to the reference voltage data $V_R$ from the reference characteristic table 11A, and a field memory DL2 for sequentially storing drive voltage data V for one field obtained from the adder 11G and outputting each drive voltage data as delay data $V_0$ with a delay of a 1-field period.

Referring to FIG. 10, $Y_1(T)$ indicates a reference characteristic curve obtained when hysteresis is omitted, $Y_{2n}(T)$ (n=1, 2, . . . ) indicates a characteristic curve for a decrease in the drive voltage, and $Y_{2n+1}(T)$ (n=1, 2, . . . ) indicates a characteristic curve for an increase in the drive voltage. The reference characteristic table 11A is formed of a ROM storing a set of reference voltage data $V_R$ to be selected by the transmittance data T. Each reference voltage data $V_R$ is 10-bit data representing a drive voltage obtained from the characteristic curve $Y_1(T)$ with respect to the transmittance data T, and the reference voltage data $V_R$ is assigned to the entire bits of the drive voltage data V. The correction table 11B is formed of a ROM storing a set of correction data $-\Delta V_1$ to be selected by the data T, $T_0$, and $V_0$. Each correction data $-\Delta V_1$ is 8-bit data representing a difference $(Y_{2n}(T)-Y_1(T))$ between drive voltages obtained from the reference characteristic curve $Y_1(T)$ and the characteristic curve $Y_{2n}(T)$ with respect to the transmittance data T, and the correction data $-\Delta V_1$ is assigned to the lower 8 bits of the drive voltage data V. The correction table 11C is formed of a ROM storing a set of correction data $+\Delta V_2$ to be selected by the data T, $T_0$, and $V_0$. Each correction data $+\Delta V_2$ is 8-bit data representing a difference ($Y_{2n+1}(T)-Y_1(T)$) between drive voltages obtained from the reference characteristic curve $Y_1(T)$ and a characteristic curve $Y_{2n+1}(T)$ with respect to the transmittance data T, and the correction data $+\Delta V_2$ is assigned to the lower 8 bits of the drive voltage data V. The correction table 11H is formed of a ROM storing a set of correction data $\Delta V_3$ to be selected by the delay data $V_0$. Each correction data $\Delta V_3$ is 8-bit data representing a difference ($V_0-Y_1(T)$) between voltages obtained from the reference characteristic curve $Y_1(T)$ and the delay data $V_0$ with respect to the transmittance data T, and the correction data $\Delta V_3$ is assigned to the lower 8 bits of the drive voltage data V.

The correction table 11B specifies the correction data $-\Delta V_1$ for the characteristic curve $Y_{2n}(T)$ having a point determined by the data $T_0$ and $V_0$ as a start point, and generates one selected from the correction data $-\Delta V_1$ by the transmittance data T. In addition, the correction table 11C specifies the correction data $+\Delta V_2$ for the characteristic curve $Y_{2n+1}(T)$ having a point determined by the data $T_0$ and $V_0$ as a start point, and generates one selected from the correction data $+\Delta V_2$ by the transmittance data T. The correction table 11H generates one selected from the correction data $\Delta V_3$ by the data T and $V_0$.

For example, when the transmittance T changes from 7.5 V to 4 V with a change in field, the correction table 11B specifies the correction data $-\Delta V_1$ for a characteristic curve $Y_4(T)$ having a point A determined by the delay data $T_0$ (=7.5 V) and the delay data $V_0$ (=5.5 V) as a start point, and generates one selected from the correction data $-\Delta V_1$ by the transmittance data T (=4 V). The subtracter 11D subtracts the delay data $T_0$ (=7.5 V) from the transmittance data T (=4 V), and the detector 11E detects that the subtraction result is negative. For this reason, the switch 11F selects the correction data $-\Delta V_1$, and the adder 11G adds the correction data $-\Delta V_1$ to the reference voltage data $V_R$ (=4 V) from the characteristic table 11A. Therefore, the drive voltage data V is set to be ($4-\Delta V_1$).

In this embodiment, the modulation characteristics of the LCD panel DP have hysteresis which can be expressed by a plurality of characteristic curves each having a start point determined by the drive voltage data V and transmittance data T used in the previous field. However, the transmittance of the LCD panel DP is controlled after the hysteresis has been compensated for according to the direction of a change in the transmittance data T. For this reason, as in the first embodiment, overlapped images can be prevented from being displayed. In addition, since each of all the correction tables 11B, 11C, and 11H stores a difference between the reference characteristic curve $Y_1(T)$ and the hysteresis characteristic curve as correction data, the dynamic range of each correction data can be made smaller than that of the reference voltage data. Therefore, even when input data to each table is of 8-bit, 10-bit drive voltage data can be obtained. Although this drive voltage data V can also be obtained from a plurality of tables directly representing the hysteresis characteristic curves, output data from each table must be of 10-bit.

Note that, when the start points of the characteristic curves $Y_{2n}(T)$ and $Y_{2n+1}(T)$ are located on the reference characteristic curve $Y_1(T)$ or near the reference characteristic curve $Y_1(T)$, it is not necessary to supply the delay data $V_0$ from the field memory DL2 to the correction tables 11B and 11C. In this case, the correction table 11B specifies the correction data $-\Delta V_1$ for the characteristic curve $Y_{2n}(T)$ having a start point on the reference characteristic curve $Y_1(T)$ determined by the transmittance data $T_0$, and generates one selected from the correction data $-\Delta V_1$ by the transmittance data T. The correction table 11C specifies the correction data $+\Delta V_2$ for the characteristic curve $Y_{2n+1}(T)$ having a start point on the reference characteristic curve $Y_1(T)$ determined by the transmittance data $T_0$, and generates one selected from the correction data $-\Delta V_2$ by the transmittance data T.

As in the first embodiment, the correction table 11H can store the correction data $-\Delta V_3$ for decreasing the drive voltage along the characteristic curve $Y_{2n}(T)$ by a level sufficiently smaller than that obtained when the transmittance data T decreases by one step, or the correction data $+\Delta V_3$ for increasing the drive voltage along the characteristic curve $Y_{2n+1}(T)$ by a level sufficiently smaller than that obtained when the transmittance data T increases by one step. In this case, the data T, $T_0$, and $V_0$ are supplied to the correction table 11H.

Figure 9:
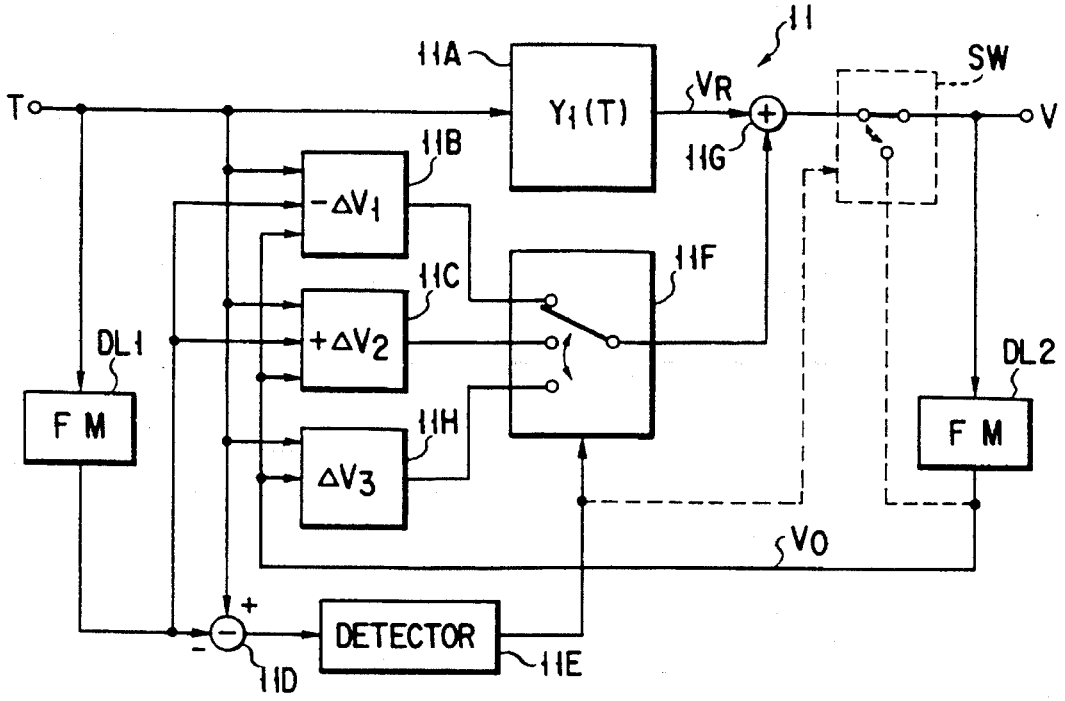
FIG. 9 is a block diagram showing the arrangement of a characteristic compensating circuit of a liquid crystal display device according to the third embodiment of the present invention.

In addition, the characteristic compensating circuit may have a switch SW connected as indicated by the broken line in FIG. 9. This switch SW performs a switching operation in which the delay data $V_0$ is selected only when the subtraction result is detected to be zero by the detector 11E. This arrangement makes the correction table 11H unnecessary.

Figure 11:
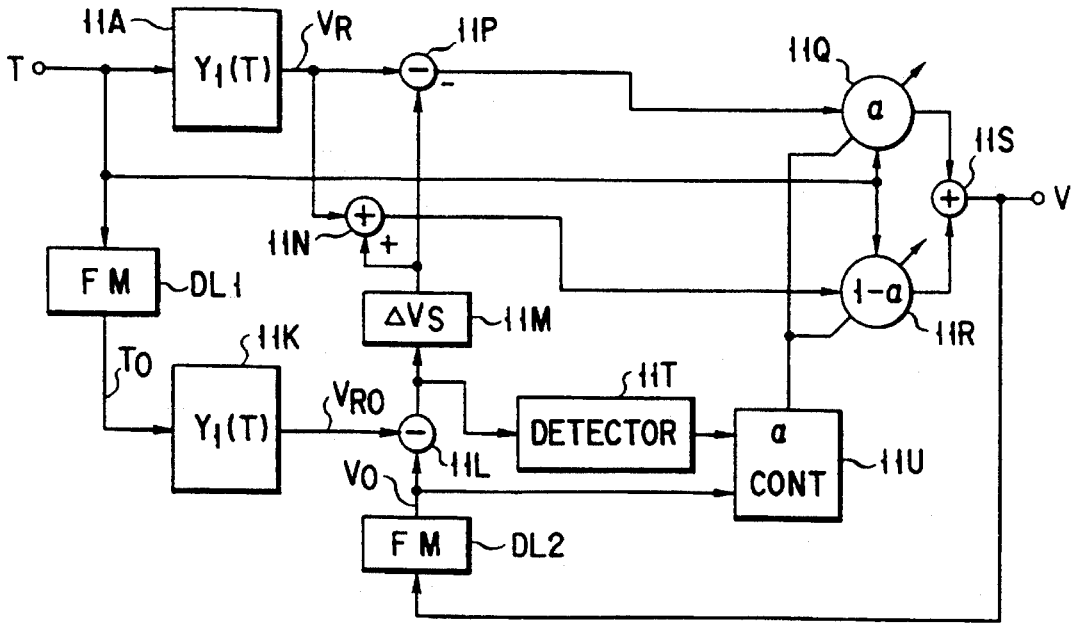
FIG. 11 is a block diagram showing the arrangement of a characteristic compensating circuit of a liquid crystal display device according to the fourth embodiment of the present invention.

A liquid crystal display device according to the fourth embodiment of the present invention will be described below with reference to the accompanying drawings. This liquid crystal display device has the same arrangement as that of the liquid crystal display device of the first embodiment except that a characteristic compensating circuit 11 has the arrangement shown in FIG. 11. For this reason, a repetitive description will be omitted, and the same reference numerals as in the first embodiment denote the substantially same components in FIG. 11. In the third embodiment, the correction tables 11B, 11C, and 11H must have a very large number of correction data according to the number of hysteresis characteristic curves.

The compensating circuit 11 has a field memory DL1 for sequentially storing transmittance data T for one field and outputting each transmittance data T as delay data $T_0$ with a delay of a 1-field period, a field memory DL2 for sequentially storing drive voltage data V for one field and outputting each drive voltage data as delay data $V_0$ with a delay of a 1-field period, a reference characteristic table 11A for generating reference voltage data $V_R$ corresponding to the transmittance data T, a reference correction table 11K for generating reference voltage data $V_{R0}$ corresponding to the transmittance data $T_0$, a subtracter 11L for subtracting the delay data $V_0$ from the reference voltage data $V_{R0}$, a correction table 11M for generating correction data Vs corresponding to a subtraction result from the subtracter 11L, an adder 11N for adding the correction data Vs to the reference voltage data $V_R$, a subtracter 11P for subtracting the correction data Vs from the reference voltage data $V_R$, a weight coefficient multiplier 11Q for multiplying a weight coefficient $\alpha$ with a subtraction result obtained from the subtracter 11P, a weight coefficient multiplier 11R for multiplying a weight coefficient ($1-\alpha$) with an addition result obtained from the adder 11N, an adder 11S for adding a multiplication result obtained from the multiplier 11Q to a multiplication result obtained from the multiplier 11R, a detector 11T for detecting whether the subtraction result obtained from the subtracter 11L is negative, positive, or zero, and a controller 11U for changing the value of the coefficient $\alpha$ on the basis of a detection result from the detector 11T and the delay data $V_0$ from the field memory DL2.

Figure 12:
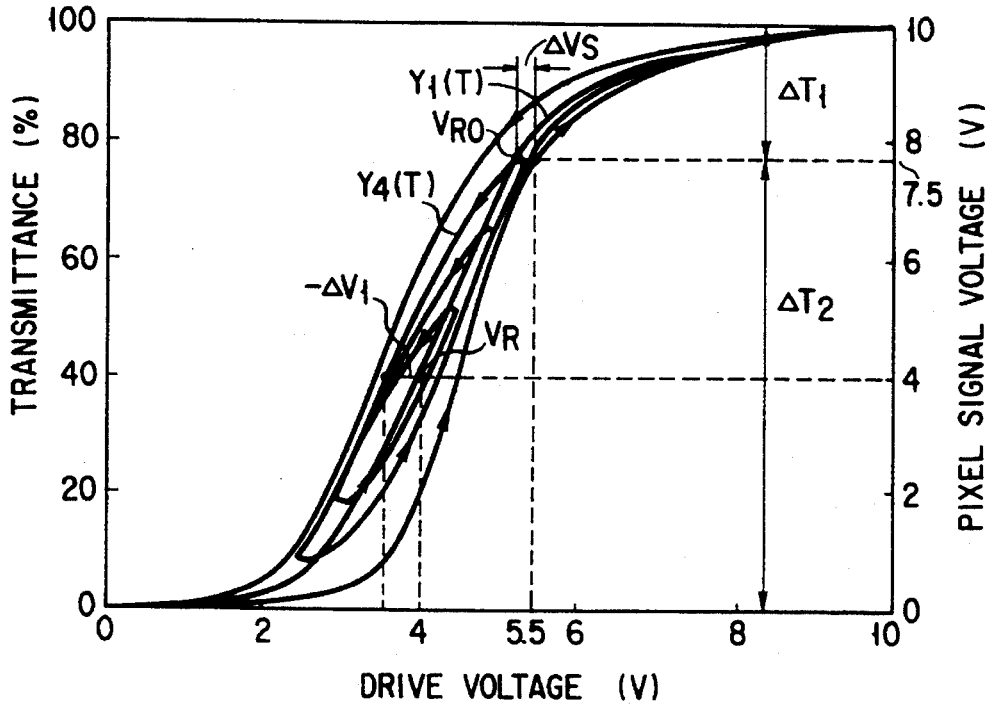
FIG. 12 is a graph for explaining an operation of the characteristic compensating circuit in FIG. 11.
Figure 13:
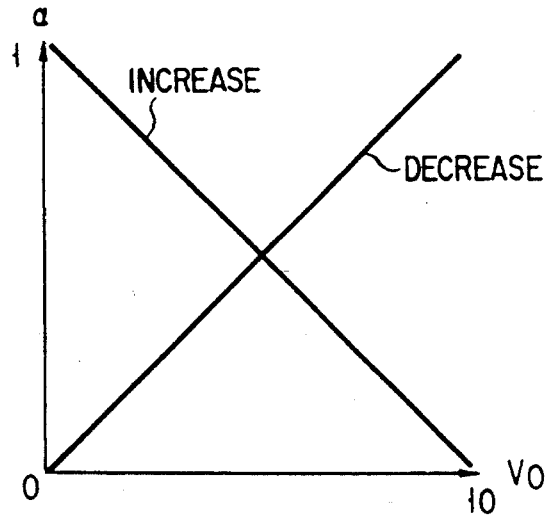
FIG. 13 is a graph showing a coefficient $\alpha$ controlled by a controller in FIG. 11.

In this embodiment, hysteresis characteristic curves shown in FIG. 12 are approximated by using the reference characteristic curve and the voltage data Vs representing a difference between each hysteresis characteristic curve and the reference characteristic curve. This is because the magnitude of hysteresis depends on $\Delta T_1$ when the transmittance increases, and on $\Delta T_2$ when the transmittance decreases. The weight coefficient $\alpha$ is controlled as shown in FIG. 13 when the transmittance increases and decreases.

The transmittance data T is supplied to the reference characteristic table 11A and the field memory DL1. The reference characteristic table 11A generates reference voltage data $V_R$ corresponding to the transmittance data T, and supplies it to the subtracter 11P and the adder 11N. The field memory DL1 delays the transmittance data T by a 1-field period, and supplies it to the reference characteristic table 11K as the delay data $T_0$. The reference characteristic table 11K generates reference voltage data $V_{R0}$ corresponding to this delay data $T_0$, and supplies it to the subtracter 11L. The field memory DL2 delays drive voltage data V by a 1-field period, and supplies it to the subtracter 11L and the controller 11U as the delay data $V_0$. The subtracter 11L subtracts the delay data $V_0$ from the reference voltage data $V_{R0}$, and supplies the subtraction result to the correction table 11M and the detector 11T. The correction table 11M generates correction data Vs corresponding to the subtraction result, and supplies it to the adder 11N and the subtracter 11P. The adder 11N adds the correction data Vs to the reference voltage data $V_R$, and supplies the addition result to the multiplier 11R. The subtracter 11P subtracts the correction data Vs from the reference voltage data $V_R$, and supplies the subtraction result to the multiplier 11Q. The multiplier 11Q multiplies the weight coefficient $\alpha$ with the subtraction result from the subtracter 11P, and supplies the multiplication result to the adder 11S. The multiplier 11R multiplies the weight coefficient $(1-\alpha)$ with the addition result from the adder 11N, and supplies the multiplication result to the adder 11S. The adder 11S adds the multiplication result from the multiplier 11Q to the multiplication result from the multiplier 11R, and outputs the addition result as the drive voltage data V. The detector 11T detects whether a subtraction result obtained from the subtracter 11L is negative, positive, or zero, and supplies the detection result to the controller 11U. The controller 11U changes the value of the coefficient $\alpha$ on the basis of the detection result and the delay data $V_0$.

According to this embodiment, the number of correction data can be made smaller than that of the third embodiment.

In addition, the characteristic compensating circuit 11 can be constituted to sense a temperature and perform the hysteresis compensation according to the sensed temperature. The modulation characteristics of a liquid crystal cell tends to have relatively small hysteresis when the room temperature is high, and significantly large hysteresis when the room temperature is low. Therefore, the above construction is required in order to cancel the hysteresis depending on the temperature when the liquid crystal display device is used at a place where the room temperature is low.

A liquid crystal display device according to the fifth embodiment of the present invention will be described below with reference to the accompanying drawings. As in the same manner as the first embodiment in FIG. 4, the liquid crystal display device comprises processing channels CH1 to CH3 for respectively processing three image signals S(t) obtained by separating a color video signal into color components of red, green, and blue, and an LCD panel DP which is driven according to RGB signals from the processing channels CH1 to CH3. The image signal S(t) includes pixel signals arranged in units of fields on a time axis to designate intensity (or transmittance) levels for pixels. The LCD panel DP is a polymer dispersed liquid crystal display panel conventionally known, and has an active matrix structure in which a plurality of TFTs are formed as switching elements for pixel electrodes arrayed in a matrix form on an array substrate. The rows of TFTs are sequentially selected in synchronism with the horizontal scanning cycle of the RGB signals. The selected TFTs supply pixel signals extracted from each of the RGB signals for one horizontal scanning period to those pixel electrodes of a corresponding color component which are connected to the selected TFTs.

The processing channels CH1 to CH3 have arrangements similar to each other. Each of the processing channels CH1 to CH3 has an intensity detector 10 for sequentially detecting intensity (or transmittance) levels from pixel signals included in the image signal S(t) and converting each transmittance level into 8-bit transmittance data T, a characteristic compensating circuit 11 for generating 10-bit drive voltage data V on the basis of the transmittance data T from the intensity detector 10, and a polarity switching circuit 13 for generating a drive voltage designated by the drive voltage data V from the compensating circuit 11 and switching the polarity of the drive voltage for each horizontal scanning period. The RGB signals are constituted by three voltage signals respectively obtained from the polarity switching circuits 13 of the processing channels CH1 to CH3.

Figure 14:
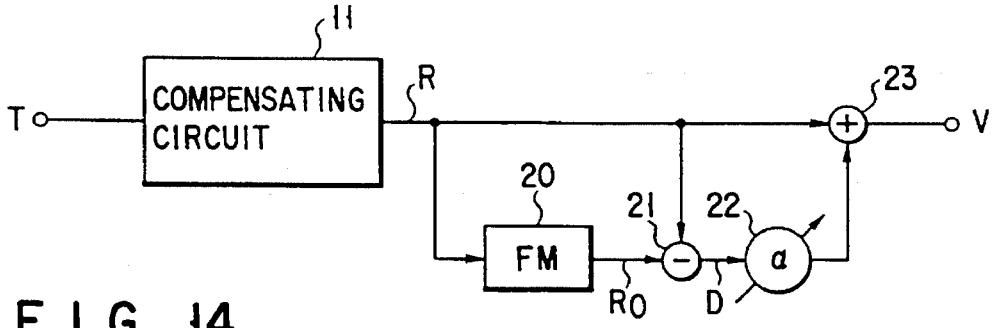
FIG. 14 is a block diagram showing the arrangement of a characteristic compensating circuit of a liquid crystal display device according to the fifth embodiment of the present invention.

In the liquid crystal display device, the characteristic compensating circuit 11 is arranged as shown in FIG. 14. Referring to FIG. 14, 11V denotes anyone of the hysteresis characteristic compensating circuits shown in FIGS. 5, 8, 9, and 11, and R denotes voltage data input from the characteristic compensating circuit 11V. In addition to this circuit 11V, the characteristic compensating circuit 11 of this display device includes a response characteristic compensating circuit which compensates for the response characteristics of the LCD panel DP.

The response characteristic compensating circuit has a field memory 20, a subtracter 21, a multiplier 22, and an adder 23. The field memory 20 stores input voltage data R for one field and outputs each voltage data as delay data $R_0$ with a delay of a 1-field period. The subtracter 21 serves as a level change detector for detecting a difference between the input voltage data R and the delay data $R_0$ as the amount of a level change. The amount of the level change for each pixel is supplied from the subtracter 21 to a time-axis filter as difference data D. The time-axis filter is constituted by a weight circuit 22 which multiplies the difference data D with a weight coefficient $\alpha$ suitable for the response characteristics of the liquid crystal cell in the LCD panel DP, and an adder 23 for adding the multiplied difference data D to the input voltage data R. The time-axis filter serves as an adaptive filter whose filtering characteristics vary with the difference data D, and performs a high-frequency correction on the input voltage data R to supply the corrected data to the polarity switching circuit 13 as drive voltage data V.

Figure 15:
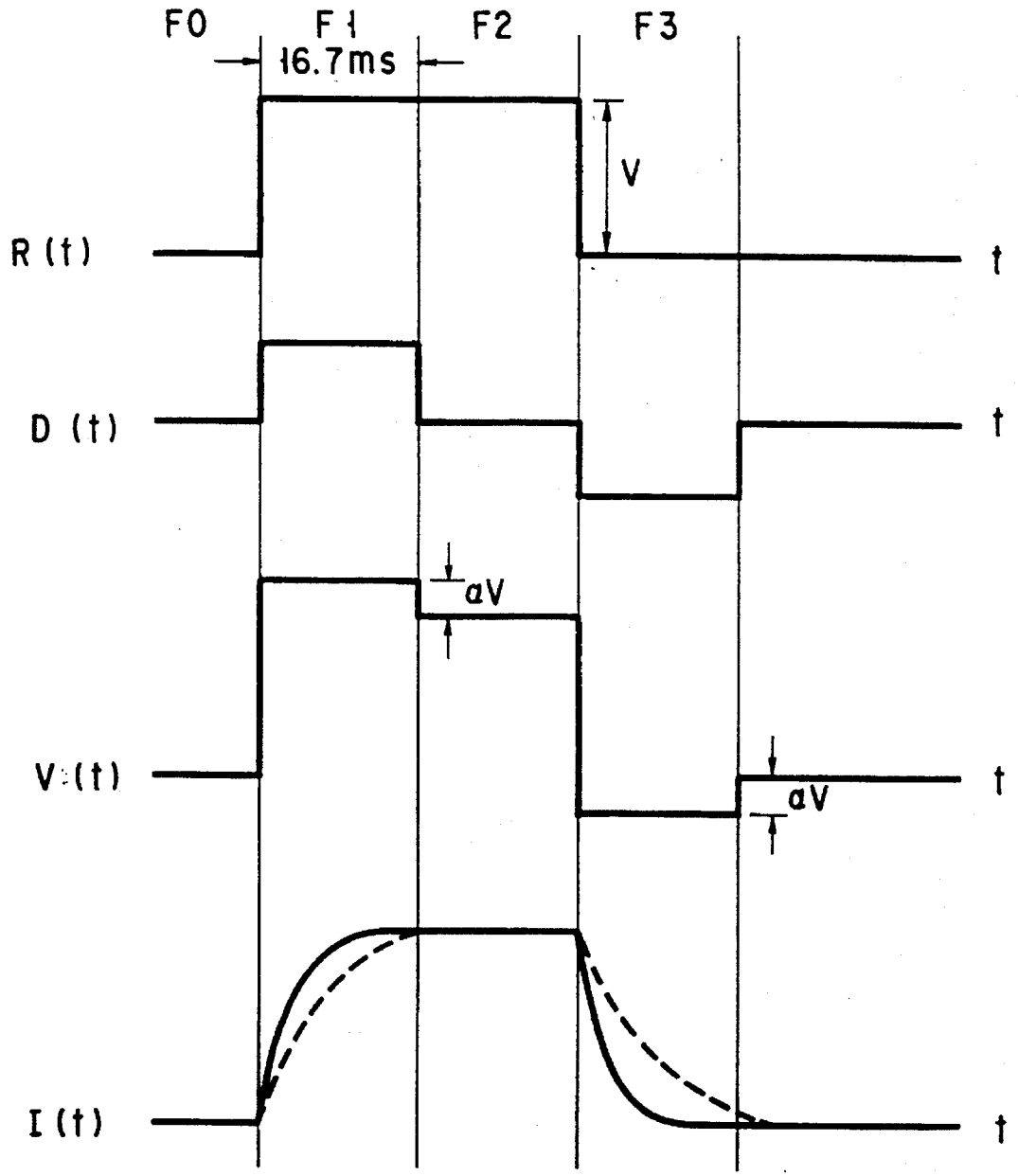
FIG. 15 is a timechart for explaining an operation of the liquid crystal display device according to the fifth embodiment.

An operation of this liquid crystal display device will be described with reference to FIG. 15. In order to readily understand the operation, assume that the input voltage data R(t) is a digital signal representing transmittance of high and low levels which can be changed for each 1-field period (1/60 seconds). Referring to FIG. 15, the input voltage data R(t) is set at high level in a field F1, kept at high level in a field F2, and set at low level in a field F3. In this case, the difference data D(t) changes on the time axis in accordance with a change in the input voltage data R(t). More specifically, the difference data D(t) is set, in the field F1, at a positive level equal to the level difference of the input voltage data R(t) between a field F0 and the field F1, and set, in the field F2, at zero level equal to the level difference of the input voltage data R(t) between the filed F1 and the field F2, and set, in the field F3, at a negative level equal to the level difference of the input voltage data R(t) between the field F2 and the field F3.

Although the input voltage data R(t) can be basically corrected by the difference data D(t), overshooting occurs if response characteristics inherent to the liquid crystal cell are not considered. For this reason, actual correction is performed as follows. That is, a weight coefficient α preset to be suitable for the response characteristics inherent to the liquid crystal cell is multiplied with the difference data D(t), and the resultant value is added to the input voltage data R(t), thereby preventing this overshooting. In this manner, the input voltage data R(t) is converted into the high-frequency corrected drive voltage data V(t) which varies as shown in FIG. 15. This high-frequency corrected drive voltage data V(t) is supplied to the LCD panel DP through the polarity switching circuit 13 to control the transmittance of the liquid crystal cell. This control causes a transmitted light intensity I(t) to change along the waveform indicated by the sold line. Since this waveform rises and falls within a time shorter than that of an original waveform indicated by the broken line, the response characteristics of the liquid crystal cell are improved.

In correction of the input voltage data R(t), the transfer function of the liquid crystal cell is represented by HLCD(ωt), frequency characteristics Ht(ωt) are obtained by multiplying a high-frequency emphasis function Hc(ωt) with the transfer function HLCD(ωt) and expressed by the following equations:

$$Ht(\omega t) = HLCD(\omega t) \cdot Hc(\omega t)$$
$$Hc(\omega t) = \alpha\{1 - \exp(j \cdot 2\pi\omega t/\omega c)\} + 1$$
$$\omega c = 2\pi/60$$

Figure 16:
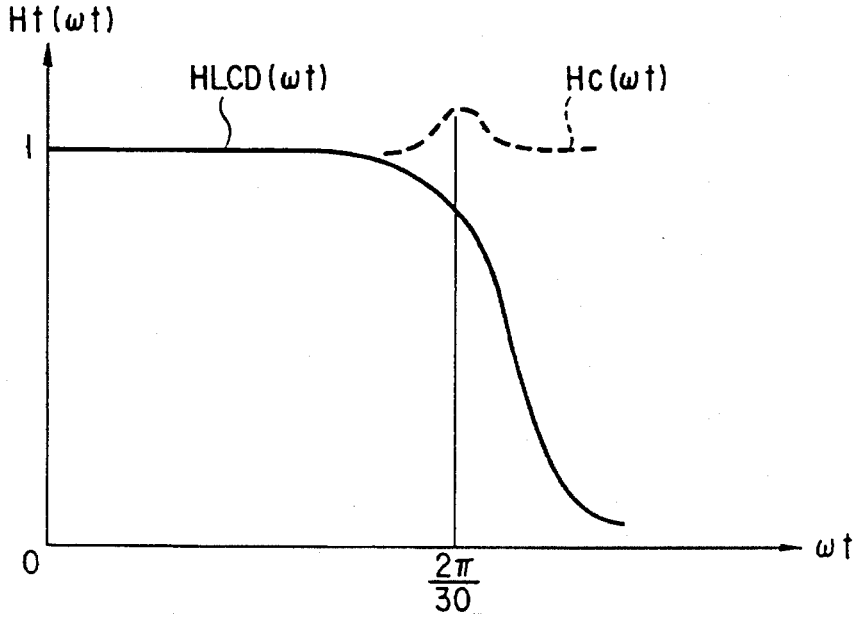
FIG. 16 is a graph for explaining an operation of the characteristic compensating circuit which compensates for the response characteristics of a liquid crystal display panel in the fifth embodiment.

More specifically, the above liquid crystal display apparatus compensates for a decrease in HLCD (ωt) with Hc(ωt) as shown in FIG. 16 to widen the band of Ht(ωt). The actual frequency characteristics can be obtained by solving the equations (3) to (5) using the weight coefficient α as a parameter.

However, in this liquid crystal display device, when the response of the liquid crystal cell is considerably delayed, or when a light intensity does not reach a desired level after one field due to restrictions related to a voltage applied between a pixel electrode and a common electrode, an image may not be faithfully reproduced due to high-frequency emphasis. In consideration of this, a high-frequency emphasis amount become short. For this reason, the response characteristics of the liquid crystal cell can hardly be sufficiently improved.

A liquid crystal display device according to the sixth embodiment will be described below with reference to the accompanying drawings. This embodiment is applied to a case where the response of a liquid crystal cell is considerably delayed as described above so that a change in the light intensity cannot be completed before the next field.

As in the same manner as the first embodiment in FIG. 4, the liquid crystal display device comprises processing channels CH1 to CH3 for respectively processing three image signals S(t) obtained by separating a color video signal into color components of red, green, and blue, and an LCD panel DP which is driven according to RGB Signals from the processing channels CH1 to CH3. The image signal S(t) includes pixel signals arranged in units of fields on a time axis to designate intensity (or transmittance) levels for pixels.

The LCD panel DP is a conventionally known TN liquid crystal display panel which does not have hysteresis in the modulation characteristics, and has an active matrix structure in which a plurality of TFTs are formed as switching elements for pixel electrodes arrayed in a matrix form on an array substrate. The rows of TFTs are sequentially selected in synchronism with the horizontal scanning cycle of the RGB signals. The selected TFTs supply pixel signals extracted from each of the RGB signals for one horizontal scanning period to those pixel electrodes of a corresponding color component which are connected to the selected TFTs.

The processing channels CH1 to CH3 have arrangements similar to each other. Each of the processing channels CH1 to CH3 has an intensity detector 10 for sequentially detecting intensity (or transmittance) levels from pixel signals included in the image signal S(t) and converting each transmittance level into 8-bit transmittance data T, a characteristic compensating circuit 11 for generating 10-bit drive voltage data V on the basis of the transmittance data T from the intensity detector 10, and a polarity switching circuit 13 for generating a drive voltage designated by the drive voltage data V from the compensating circuit 11 and switching the polarity of the drive voltage for each horizontal scanning period. The RGB signals are constituted by three voltage signals respectively obtained from the polarity switching circuits 13 of the processing channels CH1 to CH3.

Figure 17:
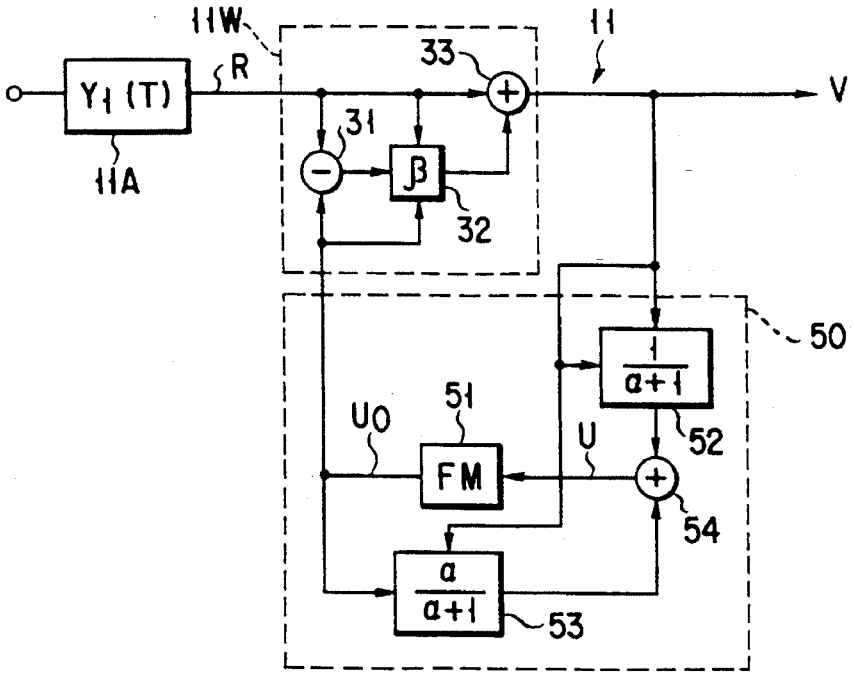
FIG. 17 is a block diagram showing the arrangement of a characteristic compensating circuit of a liquid crystal display device according to the sixth embodiment of the present invention.

As shown in FIG. 17, the characteristic compensating circuit 11 of the liquid crystal display device comprises a reference characteristic table 11A, a response compensating section 11W, and a response predicting section 50.

The reference characteristic table 11A generates reference voltage data corresponding to the transmittance data, as input voltage data. The response compensating section 11W performs processing on the input voltage data R to compensate for the response characteristics of the liquid crystal cell in the LCD panel DP. The response predicting section 50 simulates a response of the LCD panel DP with respect to drive voltage data V from the response compensating section 11W, delays voltage data U predicted by the simulation for one field as delay data $U_0$, and supplies the delay data $U_0$ to the response compensating section 11W.

The response compensating section 11W is constituted by a subtracter 31, a weight coefficient multiplier 32, and an adder 33. The subtracter 31 serves as a level change detector for detecting a difference between the input voltage data R and the delay data $U_0$ as the amount of a level change. The amount of the level change for each pixel is supplied from the subtracter 31 to a high-frequency emphasis filter as difference data. The high-frequency emphasis filter is constituted by the multiplier 32 which multiplies the difference data with a weight coefficient β suitable for the response characteristics of the liquid crystal cell in the LCD panel DP, and an adder 23 for adding the multiplied difference data to the input voltage data R. The time-axis filter serves as an adaptive filter whose filtering characteristics vary with the difference data, and performs a high-frequency correction on the input voltage data R to supply the corrected data to the polarity switching circuit 13 as drive voltage data V.

The coefficient β is preset such that the liquid crystal cell properly responds to a drive voltage determined by the delay data $U_0$ from the response predicting section 24 and the input voltage data R. That is, the characteristics of the high-frequency emphasis filter is expressed by the following equation.

$$V=\beta*(R-U_0)+R=(\beta+1)*R-\beta U_0\ \beta=\beta(V)$$

Although the response characteristics of the liquid crystal cell can be generally approximated by a low-pass filter (to be referred to as an LPF hereinafter), since the response characteristics of an actual liquid crystal cell change depending on a level of the drive voltage, the response characteristics are approximated using a voltage level dependency type LPF group as an LPF. Although this LPF group can be variously arranged, an arrangement in which a coefficient $\alpha$ is changed by a voltage level is employed in this embodiment as shown in FIG. 17. That is, the response predicting section 50 comprises a field memory 51 for storing predicted voltage data U for one field and delaying the voltage data U by a 1-field period, a weight coefficient multiplier 52 for multiplying a weight coefficient $1/(\alpha+1)$ with the drive voltage data V, a weight coefficient multiplier 53 for multiplying a weight coefficient $\alpha/(\alpha+1)$ with the delay data $U_0$, and an adder 54 for adding the results from the multipliers 52 and 53 to each other. The adder 54 supplies the addition result to the field memory 51 as predicted voltage data U representing a response voltage level of the liquid crystal cell predicted under the control of the drive voltage data V. Accordingly, the delay data $U_0$ from the field memory 51 represents a response voltage of the immediately preceding field, i.e., the initial voltage when the drive voltage is designated by the input voltage data R. In the response predicting section 50, the predicted voltage data U from the LPF is given by the following equation:

$$U=\{\alpha/(\alpha+1)\}*U_0+\{1/(\alpha+1)\}*V\alpha=\alpha(V)$$

In this manner, the actual response voltage of the liquid crystal cell in the immediately succeeding field can be approximated as an output from the LPF. When this voltage is used as an initial voltage used in the next field, accurate characteristic simulation can be performed.

The aforementioned input voltage data R and delay data $U_0$ are supplied to the response compensating section 11W from the reference characteristic table 11A and the response predicting section 50, respectively. The response compensating section 11W performs a high-frequency emphasis on the input voltage data R by an emphasis amount $\beta$ determined by the delay data $U_0$ and the input voltage data R, and supplies the data obtained by the emphasis to the polarity switching circuit 13 as the drive voltage data V.

In a case where a target transmittance cannot be obtained in the immediately succeeding field under the aforementioned control of the drive voltage data V, this control can be optimized by repeating a process of determining a predicted voltage data by the LPF and then storing the data.

When $\alpha=\beta$, the final predicted voltage data U becomes equals to the input voltage data R, i.e., U=R can be established. Therefore, the the voltage data U can completely follow the voltage data R.

In this embodiment, although the response characteristics of the liquid crystal cell are approximated by a linear LPF, since the response characteristics of an actual liquid crystal cell have a complex form including many high- and low-frequency components, the response characteristics cannot be completely compensated for by a control operation performed in units of fields. For this reason, $\alpha=\beta$ does not mean an optimal control operation. In addition, the visual characteristics of a person have band-pass filter characteristics or low-pass filter characteristics. For this reason, when compensation is slightly excessively performed such that characteristics including the visual characteristics are overshot, a good control operation can be performed.

In this embodiment, the input voltage data R is corrected by voltage data predicted based on the response characteristics of the liquid crystal cell. This makes it possible to compensate for the voltage response characteristics of a liquid crystal cell which conventional liquid crystal display devices cannot compensate for. Therefore, even if moving images using a halftone range are displayed on the LCD panel having a liquid crystal which has a low response speed, abrupt changes in brightness can be reproduced faithfully. Accordingly, this LCD panel can be used as a TV display.

Figure 18:
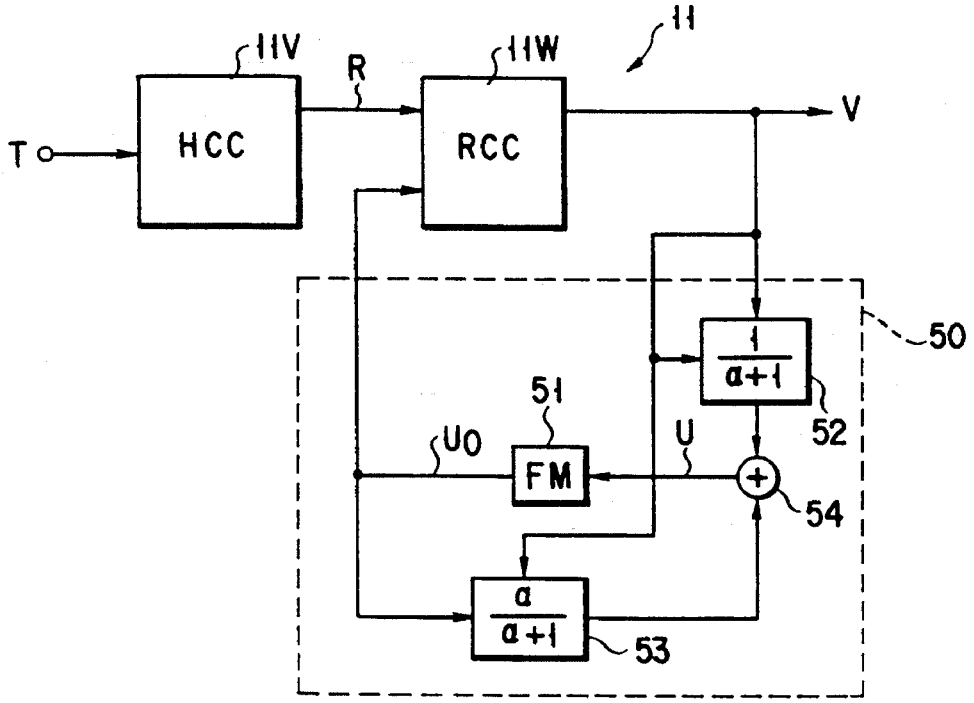
FIG. 18 is a block diagram showing the arrangement of a characteristic compensating circuit of a liquid crystal display device according to the seventh embodiment of the present invention.

A liquid crystal display device according to the seventh embodiment of the present invention will be described below with reference to the accompanying drawings. This liquid crystal display device has the same arrangement as that of the liquid crystal display device of the sixth embodiment except that a characteristic compensating circuit 11 has the arrangement shown in FIG. 18. For this reason, a repetitive description will be omitted, and the same reference numerals as in the first embodiment denote the substantially same components in FIG. 18. The LCD panel DP is a polymer dispersed liquid crystal display panel which has hysteresis in the modulation characteristics.

This embodiment is applied to a case where the response of the LCD panel DP becomes stable in the immediately succeeding field. The characteristic compensating circuit 11 includes a hysteresis compensating circuit 11V shown in FIG. 14, in place of the reference characteristic table 11A shown in FIG. 17.

The compensating circuit 11V generates drive voltage data which can obtain a transmittance designated by the transmittance data T in the LCD panel DP, regardless of the initial voltage in the LCD panel DP. The response compensating section 11W receives drive voltage data obtained from the compensating circuit 11V as input voltage data R and delay data $U_0$ obtained from the response predicting section 50 in the same manner as in the previous embodiment, performs high-frequency emphasis on the input voltage data R by an emphasis amount $\beta$ determined by these data, and supplies it to the polarity switching circuit 13. Therefore, hysteresis and response compensation is sequentially performed on transmittance data for one field.

Since the modulation characteristics of a liquid crystal cell are nonlinear, 10-bit drive voltage precision is required in order to obtain 8-bit precision as final transmittance precision. The gamma correction is conventionally performed by 10-bit data processing. However, this considerably increases a circuit size. According to this embodiment, inverse nonlinear characteristics (gamma characteristics) and hysteresis compensating characteristics are formed as a table in the ROM of the compensating circuit 11V. Therefore, 10-bit drive voltage data can be obtained from 8-bit transmittance data. That is, since it is not necessary to process data of 10 bits, the circuit size is effectively reduced.

In this embodiment, the response of a liquid crystal cell with respect to a drive voltage is predicted, and a characteristic compensation process is performed on the input voltage data R according to a result of prediction. Therefore, it possible to compensate for the slow response of the liquid crystal cell which conventional liquid crystal display devices cannot compensate for. Even if halftone moving images such as TV images are displayed using the liquid crystal cell, abrupt changes in brightness can be reproduced faithfully.

Note that, when the modulation characteristics of the liquid crystal cell can be parametrically expressed using an approximate expression, the correction tables can be replaced by a logic circuit for compensating the modulation characteristics.

Figure 19:
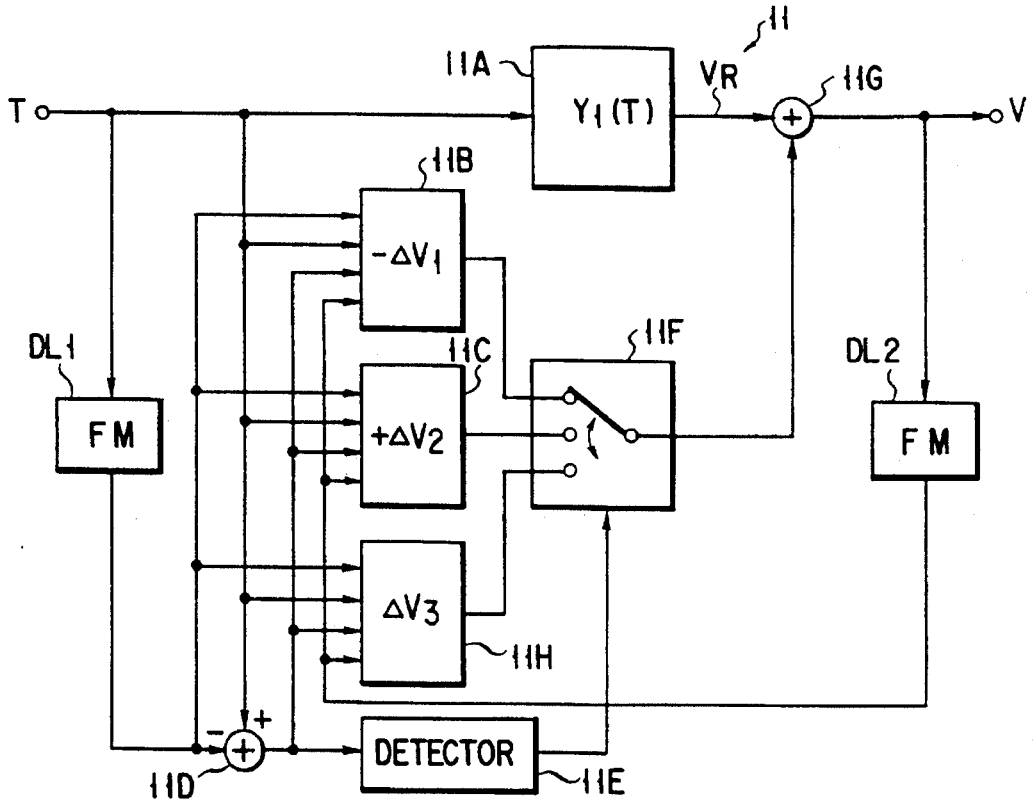
FIG. 19 is a block diagram showing the arrangement of a characteristic compensating circuit of a liquid crystal display device according to the eighth embodiment of the present invention.

A liquid crystal display device according to the eighth embodiment of the present invention will be described below with reference to the accompanying drawings. This liquid crystal display device has the same arrangement as that of the liquid crystal display device of the first embodiment except that a characteristic compensating circuit 11 has the arrangement shown in FIG. 19. For this reason, a repetitive description will be omitted, and the same reference numerals as in the first embodiment denote the substantially same components in FIG. 19.

This embodiment is applied to a case where the response characteristic of the liquid crystal cell depends on transmittance which can be set to different levels with respect to the same drive voltage due to hysteresis. This dependency has been confirmed in polymer dispersed liquid crystal, ferroelectric liquid crystal, anti-ferroelectric liquid crystal, and some materials having hysteresis.

The characteristic compensating circuit 11 has a field memory DL1 for sequentially storing transmittance data T for one field and outputting each transmittance data T as delay data $T_0$ with a delay of a 1-field period, a reference characteristic table 11A for generating reference voltage data $V_R$ corresponding to the transmittance data T, a correction table 11B for generating correction data $-\Delta V_1$ corresponding to data T, $T_0$, D and $V_0$, a correction table 11C for generating correction data $+\Delta V_2$ corresponding to the data T, $T_0$, D and $V_0$, a correction table 11H for generating correction data $\Delta V_3$ corresponding to the data T, $T_0$, D and $V_0$, a subtracter 11D for subtracting the delay data $T_0$ from the transmittance data T, a detector 11E for detecting whether difference data D obtained as a subtraction result from the subtracter 11D is negative, positive, or zero, a switch 11F for selecting the correction data $-\Delta V_1$ when the difference data D is negative, the correction data $+\Delta V_2$ when the difference data is positive, and the correction data $\Delta V_3$ when the difference data is zero, an adder 11G for adding the correction data selected by the switch 11F to the reference voltage data $V_R$ from the reference characteristic table 11A, and a field memory DL2 for sequentially storing drive voltage data V for one field obtained from the adder 11G and outputting each drive voltage data as delay data $V_0$ with a delay of a 1-field period.

In this arrangement, since the drive voltage data V is generated according to the delay data $T_0$ and $V_0$, the response characteristics of the liquid crystal cell also can be compensated for.

In addition, correction data can be reduced by modifying the arrangement such that the response characteristic compensation is performed only for halftones, since the response of the liquid crystal cell is considerably delayed in the halftone range.

Figure 20:
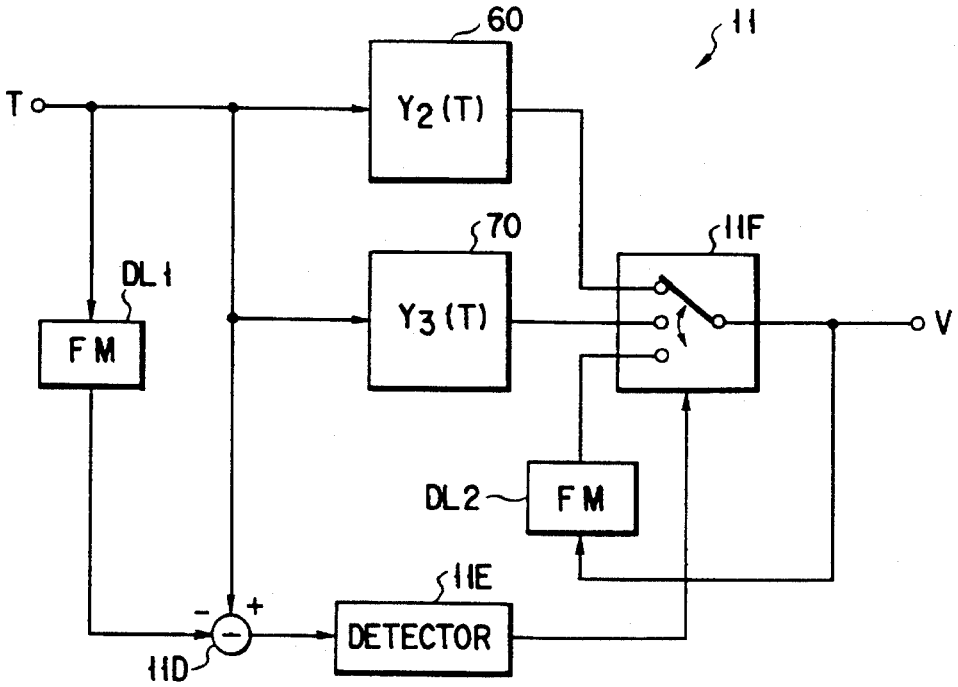
FIG. 20 is a block diagram showing the arrangement of a characteristic compensating circuit of a liquid crystal display device according to the ninth embodiment of the present invention.

A liquid crystal display device according to the ninth embodiment of the present invention will be described below with reference to the accompanying drawings. This liquid crystal display device has the same arrangement as that of the liquid crystal display device of the first embodiment except that a characteristic compensating circuit 11 has the arrangement shown in FIG. 20. For this reason, a repetitive description will be omitted, and the same reference numerals as in the first embodiment denote the substantially same components in FIG. 20.

The characteristic compensating circuit is used to compensate for the modulation characteristics shown in FIG. 6. The characteristic compensating circuit 11 has a field memory DL1 for sequentially storing transmittance data T for one field and outputting each transmittance data T as delay data $T_0$ with a delay of a 1-field period, a hysteresis characteristic table 60 for generating voltage data $V_d$ corresponding to the transmittance data T, a hysteresis characteristic table 70 for generating voltage data $V_u$ corresponding to transmittance data T, a field memory DL2 for sequentially storing drive voltage data V for one field and outputting each drive voltage data as delay data $V_0$ with a delay of a 1-field period, a subtracter 11D for subtracting the delay data $T_0$ from the transmittance data T, a detector 11E for detecting whether difference data D obtained as a subtraction result from the subtracter 11D is negative, positive, or zero, and a switch 11F for selecting the data $V_d$ when the difference data D is negative, the data $V_u$ when the difference data is positive, and the data $V_0$ when the difference data is zero. The voltage data $V_d$ represents a drive voltage on the characteristic curve $Y_2(T)$, the voltage data $V_u$ represents a drive voltage on the characteristic curve $Y_3(T)$.

The hysteresis compensation can be performed by the arrangement described above. However, In order to obtain 10-bit drive voltage data V, the hysteresis characteristic tables 60 and 70 must have ROMs storing two sets of 10-bit voltage data $V_d$ and $V_u$ to be selected by the transmittance data T.

Additional advantages and modifications will readily occur to those skilled in the art. Therefore, the invention in its broader aspects is not limited to the specific details, an representative devices, shown and described herein. Accordingly, various modifications may be made without departing from the spirit or scope of the general inventive concept as defined by the appended claims and their equivalents.

What is claimed is:

1. A display device, comprising:

an optical modulating element, having modulating characteristics in which a relationship between transmittance and a drive voltage depends on the direction of a change in the drive voltage, for modulating source light in a two-dimensional area; and driving means for applying the drive voltage to the optical modulating element in accordance with each of pixel signals changeable for each predetermined period;

wherein said driving means includes:

first delaying means for delaying said pixel signal by the predetermined period;

second delaying means for delaying said drive voltage signal by said predetermined period; and characteristic compensating means for converting the pixel signal into a drive voltage signal on the basis of converting characteristics which vary with the pixel signal and the signals delayed by said first and second delaying means, and for determining the drive voltage according to the drive voltage signal;

wherein said compensating means includes:

first converting means for converting said pixel signal into the reference voltage signal on the basis of reference converting characteristics represented by a reference characteristic curve which is preset between first characteristic curves representing said modulating characteristics for an increase of the drive voltage, and second characteristic curves representing said modulating characteristics for a decrease of the drive voltage;

second converting means for converting the delay signal obtained said first delaying means into the reference voltage signal on the basis of said reference converting characteristics;

first subtracting means for subtracting the delay signal obtained from said second delaying means, from the reference voltage signal obtained from said second converting means;

correction voltage setting means for generating a correction voltage signal which represents an absolute value of voltage equal to an amount of shift by which said reference characteristic curve is shifted along a drive voltage axis to approximate the first and second characteristic curves selected according to a subtraction result from said first subtracting means;

first adding means for adding the correction voltage signal obtained from said correction voltage setting means, to the reference voltage signal obtained from said first converting means;

second subtracting means for subtracting the correction voltage signal obtained from said correction voltage signal setting means, from the reference voltage signal obtained from said first converting means;

first multiplying means for multiplying a subtraction result obtained from said second subtracting means, by a weighting coefficient $\alpha$;

second multiplying means for multiplying an addition result obtained from said first adding means, by a weighting coefficient $1-\alpha$;

second adding means for adding a multiplication result from said first multiplying means to that from said second multiplying means to obtain said drive voltage signal;

detecting means for detecting a shifting direction of said reference characteristic curve from a subtraction result from said first subtracting means; and coefficient controlling means for adjusting said weighting coefficient $\alpha$ in accordance with detection results from said detecting means and the delay signal from said second delaying means.

2. A display device, comprising:

an optical modulating element, having modulating characteristics in which a relationship between transmittance and a drive voltage depends on the direction of a change in the drive voltage, for modulating source light in a two-dimensional area; and driving means for applying the drive voltage to the optical modulating element in accordance with each of pixel signals changeable for each predetermined period;

wherein said driving means includes:

delaying means for delaying said pixel signal by the predetermined period, and characteristic compensating means for converting the pixel signal into a drive voltage signal on the basis of converting characteristics which vary with a difference between the pixel signal and the signal delayed by said delaying means, and for determining the drive voltage according to the drive voltage signal;

wherein said compensating means includes:

first converting means for converting said pixel signal into a voltage signal on the basis of converting characteristics represented by a first characteristic curve which is identical to a characteristic curve representing said modulating characteristics for an increase of the drive voltage;

second converting means for converting said pixel signal into a voltage signal on the basis of converting characteristics represented by a second characteristic curve which is identical to a characteristic curve representing said modulating characteristics for a decrease of the drive voltage;

delaying means for delaying said drive voltage signal by the predetermined period;

detecting means for detecting the direction of a change in the drive voltage based on a difference between said pixel signal and delay signal from the delaying means therein; and selecting means for selecting the voltage signals from said first converting means, said second converting means and said delaying means, as said drive voltage signal, in response to detection results of increase, decrease and no-change, respectively.

3. A display device, comprising:

an optical modulating element, having modulating characteristics in which a relationship between transmittance and a drive voltage depends on the direction of a change in the drive voltage, for modulating source light in a two-dimensional area; and driving means for applying the drive voltage to the optical modulating element in accordance with each of pixel signals changeable for each predetermined period;

wherein said driving means includes:

delaying means for delaying said pixel signal by the predetermined period, characteristic compensating means for converting the pixel signal into a drive voltage signal on the basis of converting characteristics which vary with a difference between the pixel signal and the signal delayed by said delaying means, and for determining the drive voltage according to the drive voltage signal, and response compensating means for compensating the drive voltage signal from said characteristic compensating means on the basis of response characteristics of said optical modulating element; wherein said response compensating means includes: predicting means for predicting response of said optical modulating element; and correcting means for correcting said drive voltage signal in accordance with a prediction result from said predicting means; and wherein said predicting means includes:

delaying means for delaying a prediction voltage signal by said predetermined period to generate a delay signal as said prediction result;

first multiplying means for multiplying the drive voltage signal from said correcting means of said response compensating means by $1/(1+\alpha)$, where $\alpha$ is a weighting coefficient;

second multiplying means for multiplying the delay signal from said delaying means therein by $\alpha/(1+\alpha)$; and adding means for adding a multiplication result from said first multiplying means to that from said second multiplying means to supply an addition result as the prediction voltage signal to said delaying means therein.

4. A display device according to claim 3, wherein said correcting means includes:

subtracting means for detecting a difference between said drive voltage signal from said characteristic compensating means, and the delay signal from said delaying means of said response compensating means;

weighting means for weighting a difference signal obtained from the subtracting means; and adding means for adding the weighted difference signal to the drive voltage signal from said characteristic compensating means.

5. A display device comprising:

an optical converting element, having modulating characteristics in which a relationship between transmittance and a drive voltage is independent of the direction of a change in the drive voltage, for modulating source light in a two-dimensional area; and driving means for applying the drive voltage to the optical modulating element in accordance with each of pixel elements changeable for each predetermined period;

wherein said driving means includes:

converting means for converting said pixel signal into a drive voltage signal on the basis of converting characteristics represented by a characteristic curve identical to that representing said modulating characteristics;

predicting means for predicting response of said optical modulating element; and correcting means for correcting said drive voltage signal in accordance with a prediction result from said predicting means, and for determining said drive voltage according to the corrected drive signal; and wherein said predicting means includes:

delaying means for delaying a prediction voltage signal by said predetermined period to generate a delay signal as said prediction result;

first multiplying means for multiplying the drive voltage signal from said correcting means, by $1/(1+\alpha)$, where $\alpha$ is a weighting coefficient;

second multiplying means for multiplying the delay signal from said delaying means, by $\alpha/(1+\alpha)$; and adding means for adding a multiplication result from said first multiplying means to that from second multiplying means to supply an addition result as the prediction voltage signal to said delaying means.

6. A display device according to claim 5, wherein said correcting means includes:

subtracting means for detecting a difference between said drive voltage signal from said converting means and the delay signal from said delaying means;

weighting means for weighting a difference signal obtained from said subtracting means; and adding means for adding the weighted difference signal from the subtracting means, to the drive voltage signal from said converting means.

7. A display device comprising:

an optical modulating element, having modulating characteristics in which a relationship between transmittance and a drive voltage depends on the direction of a change in the drive voltage, for modulating source light in a two-dimensional area; and driving means for applying the drive voltage to the optical modulating element in accordance with each of pixel signals changeable for each predetermined period;

wherein said driving means includes:

delaying means for delaying said pixel signal by the predetermined period; and characteristic compensating means for converting the pixel signal into a drive voltage signal on the basis of converting characteristics which vary with the pixel signal and the signal delayed by said delaying means, and for determining the drive voltage according to the drive voltage signal; and wherein said characteristic compensating means includes:

converting means for converting said pixel signal into a reference voltage signal on the basis of reference converting characteristics represented by a reference characteristic curve which is preset between a first characteristic curve representing said modulating characteristics for an increase of the drive voltage and a second characteristic curve representing said modulating characteristics for a decrease of the drive voltage;

detecting means for detecting the direction of a change in the drive voltage based on a difference between said pixel signal and said delay signal; and correcting means for correcting said reference voltage signal in accordance with a detection result obtained from said detecting means.

8. A display device according to claim 7, wherein said correcting means includes:

first correction voltage setting means for generating a first correction voltage signal which represents a difference between the drive voltage by which transmittance designated by said pixel signal is obtained on said first characteristic curve, and a reference voltage designated by said reference voltage signal;

second correction voltage setting means for generating a second correction voltage signal which represents a difference between the drive voltage required for obtaining transmittance designated by said pixel signal on said second characteristic curve, and the reference voltage designated by said reference voltage signal;

third correction voltage setting means for generating a third correction voltage signal which represents a difference between the drive voltage required for obtaining transmittance slightly different from that designated by said pixel signal on a predetermined one of the first and second characteristic curves, and the reference voltage designated by said reference voltage signal;

selecting means for selecting said first, second and third correction voltage signals in response to detection results of increase, decrease and no-change, respectively; and adding means for adding the correction voltage signal selected by said selecting means to the reference voltage signal to obtain said drive voltage signal.

9. A display device according to claim 7, wherein said correcting means includes:

a supply terminal for a first correction voltage signal which represents a voltage equal to an amount of shift by which said reference characteristic curve is shifted along a drive voltage axis to approximate said first characteristic curve;

a supply terminal for a second correction voltage signal which represents a voltage equal to an amount of shift by which said reference characteristic curve is shifted along the drive voltage axis to approximate said second characteristic curve;

a supply terminal for a third correction voltage signal which represents a voltage equal to an amount of shift by which said reference characteristic curve is shifted along the drive voltage axis to approximate a characteristic curve obtained by slightly shifting a predetermined one of the first and second characteristic curves along a transmittance axis;

selecting means for selecting said first, second and third correction voltage signals in response to detection results of increase, decrease and no-change, respectively; and adding means for adding the correction voltage signal selected by said selecting means to the reference voltage signal to obtain said drive voltage signal.

10. A display device according to claim 2, wherein said driving means includes response compensating means for compensating the drive voltage signal from said characteristic compensating means on the basis of response characteristics of said optical modulating element.

11. A display device according to claim 10, wherein said response compensating means includes:

delaying means for delaying the drive voltage signal from said characteristic compensating means by said predetermined period; and correcting means for correcting said drive voltage signal in accordance with a difference between said drive voltage signal from said characteristic compensating means and the delay signal from said delaying means therein.

12. A display device according to claim 11, wherein said correcting means includes:

subtracting means for detecting a difference between said drive voltage signal from said characteristic compensating means and the delay signal from said delaying means of response compensating means;

weighting means for weighting a difference signal obtained from said subtracting means of said response compensating means; and adding means for adding the weighted difference signal to the drive voltage signal from said characteristic compensating means.

13. A display device according to claim 10, wherein said response compensating means includes:

predicting means for predicting response of said optical modulating element; and correcting means for correcting said drive voltage signal in accordance with a prediction result from said predicting means.

14. A display device, comprising:

an optical modulating element, having modulating characteristics in which a relationship between transmittance and a drive voltage depends on the direction of a change in the drive voltage, for modulating source light in a two-dimensional area; and driving means for applying the drive voltage to the optical modulating element in accordance with each of pixel signals changeable for each predetermined period;

wherein said driving means includes:

first delaying means for delaying said pixel signal by the predetermined period;

second delaying means for delaying said drive voltage signal by said predetermined period; and characteristic compensating means for converting the pixel signal into a drive voltage signal on the basis of converting characteristics which vary with the pixel signal and the signals delayed by said first and second delaying means, and for determining the drive voltage according to the drive voltage signal;

wherein said characteristic compensating means includes:

converting means for converting said pixel signal into a reference voltage signal on the basis of reference converting characteristics represented by a reference characteristic curve which is preset between first characteristic curves representing said modulating characteristics for an increase of the drive voltage and second characteristic curves representing said modulating characteristics for a decrease of the drive voltage;

detecting means for detecting the direction of a change in the drive voltage based on a difference between said pixel signal and said delay signal obtained from said first delaying means; and correcting means for correcting said reference voltage signal in accordance with a detection result obtained from said detecting means.

15. A display device according to claim 14, wherein said correcting means includes:

first correction voltage setting means for generating a first correction voltage signal which represents a difference between the drive voltage required for obtaining transmittance designated by said pixel signal on one of the first characteristic curves selected according to the delay signals from said first and second delaying means, and the reference voltage designated by said reference voltage signal;

second correction voltage setting means for generating a second correction voltage signal which represents a difference between the drive voltage required for obtaining transmittance designated by said pixel signal on one of the second characteristic curves selected according to the delay signals from said first and second delaying means, and the reference voltage designated by said reference voltage signal;

third correction voltage setting means for generating a third correction voltage signal which represents a difference between the drive voltage required for obtaining transmittance slightly different from that designated by said pixel signal on a predetermined one of the first and second characteristic curves selected according to the delay signal from said second delaying means, and the reference voltage designated by said reference voltage signal;

selecting means for selecting said first, second and third correction voltage signals in response to detection results of increase, decrease and no-change, respectively; and adding means for adding the correction voltage signal selected by said selecting means to the reference voltage signal to obtain said drive voltage signal.

16. A display device according to claim 15, wherein said first correction voltage setting means, said second correction voltage setting means and said third correction voltage setting means are constructed such that said first, second and third correction voltage signals reflect the difference between said pixel signal and said delay signal obtained from said first delaying means to compensate response characteristics of said optical modulating element.

17. A display device according to claim 14, wherein said correcting means includes:

first correction voltage setting means for generating a first correction voltage signal which represents a difference between the drive voltage required for obtaining transmittance designated by said pixel signal on one of the first characteristic curves selected according to the delay signals from said first and second delaying means, and the reference voltage designated by said reference voltage signal;

second correction voltage setting means for generating a second correction voltage signal which represents a difference between the drive voltage required for obtaining transmittance designated by said pixel signal on one of the second characteristic curves selected according to the delay signals from said first and second delaying means, and the reference voltage designated by said reference voltage signal;

first selecting means for selecting said first and second correction voltage signals in response to detection results of increase and decrease, respectively;

adding means for adding the correction voltage signal selected by said first selecting means to the reference voltage signal; and second selecting means for selecting the voltage signal from said-adding means, as said drive voltage signal, in response to the detection results of increase and decrease, and for selecting the delay signal from said second delaying means, as said drive voltage signal, in response to the detection result of no-change.

* * * * *